US012484663B2

(12) United States Patent
Gilmore

(10) Patent No.: US 12,484,663 B2
(45) **Date of Patent: *Dec. 2, 2025**

(54) METHOD AND DEVICE FOR PREVENTING SPRAINED ANKLES

(71) Applicant: William Gilmore, Nashville, TN (US)

(72) Inventor: William Gilmore, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/384,662

(22) Filed: Oct. 27, 2023

(65) Prior Publication Data

US 2024/0065378 A1 Feb. 29, 2024

Related U.S. Application Data

(63) Continuation of application No. 17/499,206, filed on Oct. 12, 2021, now Pat. No. 11,864,626.

(60) Provisional application No. 63/090,633, filed on Oct. 12, 2020.

(51) Int. Cl.

| | |
|---|---|
| ***A43B 17/00*** | (2006.01) |
| ***A43B 7/1405*** | (2022.01) |
| ***A43B 7/1415*** | (2022.01) |
| ***A43B 7/1425*** | (2022.01) |
| ***A43B 7/1435*** | (2022.01) |
| ***A43B 7/144*** | (2022.01) |
| ***A43B 7/1463*** | (2022.01) |

(52) U.S. Cl.

CPC ..... *A43B 17/00* (2013.01); *A43B 7/1405* (2013.01); *A43B 7/1415* (2013.01); *A43B 7/1425* (2013.01); *A43B 7/1435* (2013.01); *A43B 7/144* (2013.01); *A43B 7/1463* (2022.01); *A43B 17/006* (2013.01)

(58) Field of Classification Search

CPC ..... A43B 17/006; A43B 7/14; A43B 7/1405; A43B 7/1415; A43B 7/1425; A43B 7/1435; A43B 7/144; A43B 7/1464; A43B 7/1463

USPC ..... 36/43, 44

See application file for complete search history.

(56) References Cited

U.S. PATENT DOCUMENTS

| | | | |
|---|---|---|---|
| 1,688,642 | A | 10/1928 | Mattison |
| 2,097,959 | A | 11/1937 | Whitman |
| 2,287,341 | A | 6/1942 | Burns |
| 2,423,622 | A | 7/1947 | Samblanet |
| 2,863,231 | A | 12/1958 | William |
| 3,084,695 | A | 4/1963 | Charles |
| 4,841,648 | A | 6/1989 | Shaffer |
| 5,170,572 | A | 12/1992 | Kantro |
| 5,787,608 | A | 8/1998 | Greenawalt |
| 5,799,414 | A | 9/1998 | Kellerman |
| 6,176,025 | B1 | 1/2001 | Patterson |
| 9,943,132 | B1 | 4/2018 | Tsai |
| 10,617,175 | B2 | 4/2020 | Gilmore |

(Continued)

*Primary Examiner* — Marie D Bays

(74) *Attorney, Agent, or Firm* — Ballard Spahr LLP

(57) ABSTRACT

This invention relates to a shoe insole comprising an inner sole having one or more of a support portion in the rearfoot exterior quadrant, a cushioning portion in the forefoot interior quadrant, a cushioning portion that extends from the forefoot interior quadrant to the forefoot exterior quadrant, and a cushioning portion in the rearfoot interior quadrant and the rearfoot exterior quadrant. Methods of making, using, and positioning the disclosed shoe insole and the components thereof are also described. This abstract is intended as a scanning tool for purposes of searching in the particular art and is not intended to be limiting of the present invention.

20 Claims, 27 Drawing Sheets

(56) References Cited

U.S. PATENT DOCUMENTS

| | | | | |
|---|---|---|---|---|
| 11,864,626 | B2 * | 1/2024 | Gilmore | A43B 7/1435 |
| 2002/0162250 | A1 | 11/2002 | Campbell et al. | |
| 2004/0103561 | A1 | 6/2004 | Campbell et al. | |
| 2004/0194348 | A1 | 10/2004 | Campbell et al. | |
| 2005/0166425 | A1 | 8/2005 | Seiter | |
| 2007/0033834 | A1 | 2/2007 | Cheskin | |
| 2007/0084084 | A1 | 4/2007 | Rich | |
| 2007/0261268 | A1 | 11/2007 | Nguyen | |
| 2009/0025254 | A1 | 1/2009 | Smith | |
| 2009/0094861 | A1 | 4/2009 | Orvitz | |
| 2009/0205222 | A1 | 8/2009 | McLinden | |
| 2009/0320329 | A1 | 12/2009 | Darby, II et al. | |
| 2013/0167403 | A1 | 7/2013 | Kitagawa | |
| 2015/0000158 | A1 | 1/2015 | Wang | |
| 2015/0272273 | A1 | 10/2015 | Whittingham | |
| 2015/0273959 | A1 | 10/2015 | Wynn | |
| 2016/0345670 | A1 | 12/2016 | Orand | |
| 2017/0258175 | A1 | 9/2017 | Li | |
| 2017/0360148 | A1 | 12/2017 | Hayes | |
| 2018/0014603 | A1 | 1/2018 | Saint Dunbar | |
| 2018/0020772 | A1 | 1/2018 | Mitchell | |
| 2018/0168278 | A1 | 6/2018 | Saint Dunbar | |
| 2018/0192739 | A1 | 7/2018 | Granger | |
| 2020/0154827 | A1 | 5/2020 | Kfir | |
| 2021/0274885 | A1 | 9/2021 | Billah | |
| 2022/0338595 | A1 | 10/2022 | Gilmore | |

* cited by examiner

METHOD AND DEVICE FOR PREVENTING SPRAINED ANKLES

CROSS-REFERENCE TO RELATED APPLICATIONS

This application is a continuation of U.S. application Ser. No. 17/499,206, filed on Oct. 12, 2021, which claims the benefit of U.S. Application No. 63/090,633, filed on Oct. 12, 2020, the contents of which are incorporated herein by reference in their entireties.

BACKGROUND

The human foot is a very complex biological organ. The load on the foot at heel strike is typically about one and a half times a person's body weight when a person walks. When running or carrying extra weight, such as a backpack, loads on the foot can exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions, protect the foot from injury, and improve the overall comfort of the shoe.

Insoles may be custom made to address the specific needs of an individual. They may be made based on casts of the end user's foot or may be made of a thermoplastic material that is molded to the contours of the end user's foot. Like most custommade items, custom insoles tend to be expensive because of the low volume and extensive time needed to make and fit them properly. As such, it is not practical to make such custom-made insoles for the general public.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals, cushioning insoles perform adequately while engaged in light to moderate activities, such as walking or running. That is, a cushioning insole provides sufficient cushioning and support for such activities. However, for more strenuous or technically challenging activities, such as carrying a heavy backpack or traversing difficult terrain, a typical cushioning insole will not be adequate. Under such conditions, a cushioning insole by itself would not provide enough support and control, and tends to bottom out during use by fully compressing the cushioning insole.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and increases the load on the structures of the foot. Because biological tissues such as tendons and ligaments are sensitive to the rate at which they are loaded, the abrupt change in load causes injury or damage to the foot, ankle, or leg.

Thus, there is a need for a shoe insole that provides enhanced cushioning during push-offs and landings and improved control or stability. Preferably, a shoe insole would custom-contour to the inside shape of a variety of types of shoes, be extremely light, provide enhanced cushioning capabilities, be comfortable, and have essentially zero movement or sliding. These needs and others are met by the present invention.

SUMMARY

In accordance with the purpose(s) of the invention, as embodied and broadly described herein, the invention, in one aspect, relates to shoe insoles and methods of making, using, and positioning same.

Thus, disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has a support portion in the rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$, wherein the shoe insole is sized to fit inside a shoe while still allowing room for a wearer's foot.

Also disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 $g/cm^3$, and wherein the inner sole has a first cushioning portion in a forefoot interior quadrant, wherein the first cushioning portion has a density of less than about 0.4 $g/cm^3$ and one or more of a surface area of from about 10 $cm^2$ to about 30 $cm^2$ and a cross-sectional area of from about 0.5 $cm^2$ to about 5 $cm^2$, wherein the shoe insole is sized to fit inside a shoe while still allowing room for a wearer's foot.

Also disclosed are shoe insole comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 $g/cm^3$, and wherein the inner sole has a cushioning portion that extends from the forefoot interior quadrant to the forefoot exterior quadrant, wherein the cushioning portion has a density of less than about 0.4 $g/cm^3$ and one or more of a surface area of from about 25 $cm^2$ to about 50 $cm^2$ and a cross-sectional area of from about 25 $cm^2$ to about 45 $cm^2$, wherein the shoe insole is sized to fit inside a shoe while still allowing room for a wearer's foot.

Also disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 $g/cm^3$, and having a cushioning portion in a rearfoot interior portion and the rearfoot exterior portion, wherein the cushioning portion has a density of less than about 0.4 $g/cm^3$ and one or more of a surface area of from about 25 $cm^2$ to about 45 $cm^2$ and a cross-sectional area of from about 5 $cm^2$ to about 20 $cm^2$, wherein the shoe insole is sized to fit inside a shoe while still allowing room for a wearer's foot.

Also disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 $g/cm^3$, and wherein the inner sole has: a support portion in a rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$; a first cushioning portion in a forefoot interior quadrant, wherein the first cushioning portion has a density of less than about 0.4 $g/cm^3$ and one or more of a surface area of from about 10 $cm^2$ to about 30 $cm^2$ and a cross-sectional area of from about 0.5 $cm^2$ to about 5 $cm^2$; and a second cushioning portion in a rearfoot interior portion and the rearfoot exterior portion, wherein the second cushioning portion has a density of less than about 0.4 $g/cm^3$ and one or more of a surface area of from about 25 $cm^2$ to about 45 $cm^2$ and a cross-sectional area of from about 5 $cm^2$ to about 20 $cm^2$, wherein the shoe insole is sized to fit inside a shoe while still allowing room for a wearer's foot.

Also disclosed are kits comprising a disclosed shoe insole and a shoe.

Also disclosed are shoes having a disclosed shoe insole fabricated as an integral part of the shoe.

Also disclosed are methods of positioning a disclosed shoe insole in a shoe, the method comprising placing the shoe insole in the shoe.

Also disclosed are methods of positioning a support portion having a bottom edge and an inner edge in a shoe having an exterior edge and an interior edge, the method comprising placing the support portion in a rearfoot exterior quadrant of the shoe such that the bottom edge is adjacent to the exterior edge and the inner edge extends towards the interior edge.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the invention.

Figure 1B:
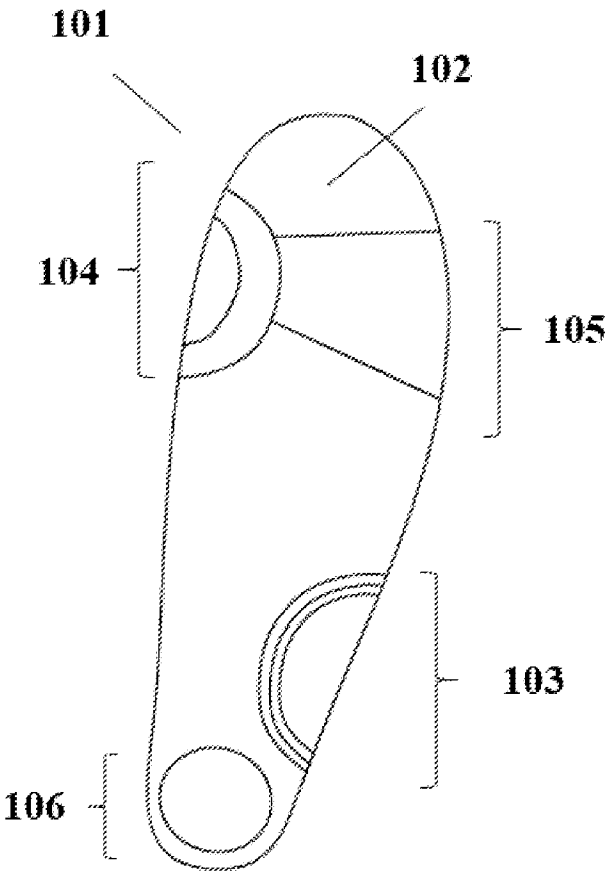
FIG. 1A and FIG. 1B show representative images of a shoe insole.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION

The present invention can be understood more readily by reference to the following detailed description of the invention and the Examples and Figures included herein.

While aspects of the present invention can be described and claimed in a particular statutory class, such as the article of manufacture statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "an inner sole," "a support portion," or "a first cushioning portion" includes mixtures of two or more such inner soles, support portions, or first cushioning portions, and the like.

As used in the specification and in the claims, the term "comprising" can include the aspects "consisting of" and "consisting essentially of."

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

As used herein, the terms "optional" or "optionally" means that the subsequently described event or circumstance can or cannot occur, and that the description includes instances where said event or circumstance occurs and instances where it does not.

As used herein, "kit" means a collection of at least two components constituting the kit. Together, the components constitute a functional unit for a given purpose. Individual member components may be physically packaged together or separately. For example, a kit comprising an instruction for using the kit may or may not physically include the instruction with other individual member components. Instead, the instruction can be supplied as a separate member component, either in a paper form or an electronic form, which may be supplied on computer readable memory device or downloaded from an internet website, or as recorded presentation.

As used herein, "instruction(s)" means documents describing relevant materials or methodologies pertaining to a kit. These materials may include any combination of the following: background information, list of components and their availability information (purchase information, etc.), brief or detailed protocols for using the kit, trouble-shooting, references, technical support, and any other related documents. Instructions can be supplied with the kit or as a separate member component, either as a paper form or an electronic form, which may be supplied on computer readable memory device or downloaded from an internet website, or as recorded presentation. Instructions can comprise one or multiple documents, and are meant to include future updates.

B. Shoe Insoles

In one aspect, disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has a support portion in the rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$, wherein the shoe insole is sized to fit inside a shoe while still allowing room for a wearer's foot.

In one aspect, disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$, wherein the shoe insole is sized to fit inside a shoe while still allowing room for a wearer's foot. In a further aspect, the inner sole further has a second cushioning portion that extends from the forefoot interior quadrant to the forefoot exterior quadrant.

In one aspect, disclosed are shoe insole comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has a cushioning portion that extends from the forefoot interior quadrant to the forefoot exterior quadrant, wherein the cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$, wherein the shoe insole is sized to fit inside a shoe while still allowing room for a wearer's foot.

In one aspect, disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and having a cushioning portion in a rearfoot interior portion and the rearfoot exterior portion, wherein the cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot.

In one aspect, disclosed are shoe insoles comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has: a support portion in a rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$; a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$; and a second cushioning portion in a rearfoot interior portion and the rearfoot exterior portion, wherein the second cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot. In a further aspect, the inner sole further has a third cushioning portion that extends from the forefoot interior quadrant to the forefoot exterior quadrant.

The disclosed shoe insole provides a full-length, semi-rigid inner sole that can promote proper alignment in several important ways. Firstly, in various aspects, the disclosed shoe insole can contain a support portion in the rearfoot exterior quadrant. Without wishing to be bound by theory, it has been found that the placement of this support portion in the rearfoot exterior quadrant beneficially helps to restore proper foot arch function, balance, and alignment. Secondly, in various aspects, the disclosed shoe insole can contain one or more cushioning portions in the forefoot interior quadrant, extending from the forefoot interior quadrant to the forefoot exterior quadrant, and in the rearfoot interior and exterior quadrants. Without wishing to be bound by theory, these cushioning portions can provide increased comfort and shock absorption.

As would be understood by one of ordinary skill in the art, shoe insoles can be used for a variety of different reasons. For example, a shoe insole can improve the fit of a shoe. Standard shoe sizes can fit differently, and it can often be difficult to find a half size. A shoe insole can be used to fill up a shoe that is a little too big to provide a more comfortable fit. Shoe insoles can also provide feet with extra warmth, which can be useful in colder weather. Shoe insoles can also help to prevent blisters; a shoe that fits "better" will not rub as much and, thus, will not cause as much irritation and discomfort. Finally, shoe insoles can also be used to improve posture (i.e., an orthotic shoe insole). Such insoles can be used to treat various problems that affect standing, walking, or running by providing additional support where needed. In various aspects, the disclosed shoe insole is an orthotic shoe insole.

Orthotic shoe insoles can be useful in treating a variety of foot problems including, but not limited to, plantar fasciitis, bursitis, tendinitis, diabetic foot ulcers, and foot, ankle, and heel pain. Without wishing to be bound by theory, it is envisioned that the disclosed shoe insoles can be useful in treating any of these foot problems by, for example, decreasing foot pain and improving function.

Shoe insoles can be made using a variety of different materials including, but not limited to foam (shock absorbing, rigid), memory foam (moulds to the shape of a wearer's foot, comfortable, long-lasting), gel (increase grip, prevent slipping), air cushioned materials (i.e., materials that contain pressurized air bubbles inside a foam sole; comfortable and cushioning), leather (durable, provides strong arch support), carbon fiber, and plastic.

Figure 1A:
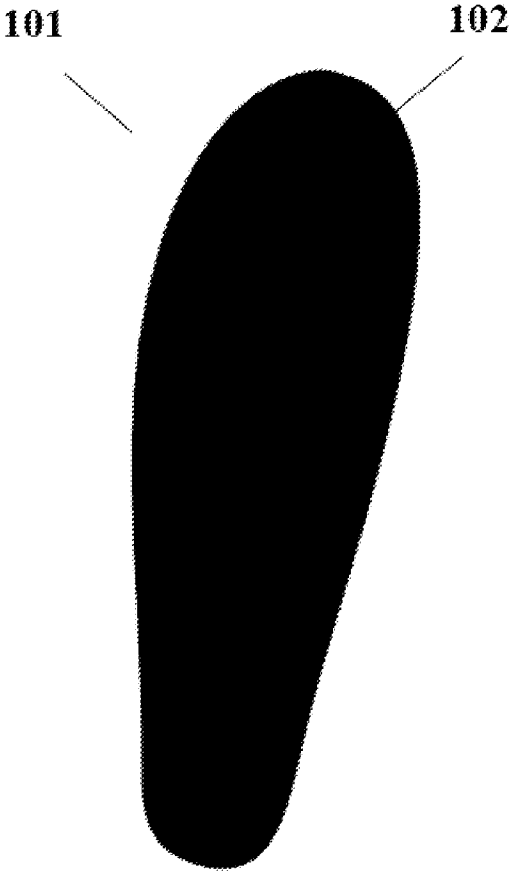

Referring to FIG. 1A and FIG. 1B, for example, shoe insole 101 can comprise inner sole 102. As shown in FIG. 1A, inner sole 102 can be formed as a solid unit, which can be made of any material known to be useful in shoe insoles such as, for example, a semi-rigid material (e.g., nylon, polyethylene, polypropylene, thermoplastic urethane). As shown in FIG. 1B, inner sole 102 can contain a variety of components that differ in, for example, thickness and/or density. These components can include support portion 103, first cushioning portion 104, second cushioning portion 105, and third cushioning portion 106, although all components need not simultaneously be present.

Figure 2B:
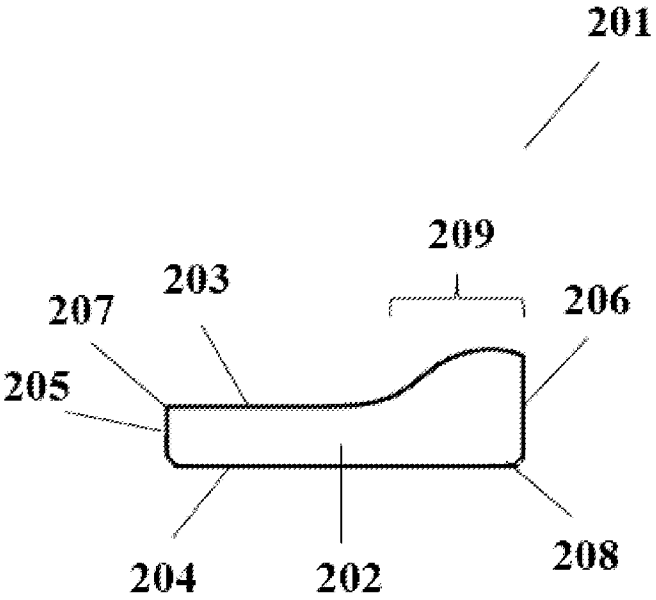
FIG. 2A-C show representative images of a back view of a left shoe insole (FIG. 2A), a back view of a right shoe insole (FIG. 2B), and a side view of a shoe insole (FIG. 2C).
Figure 2A:
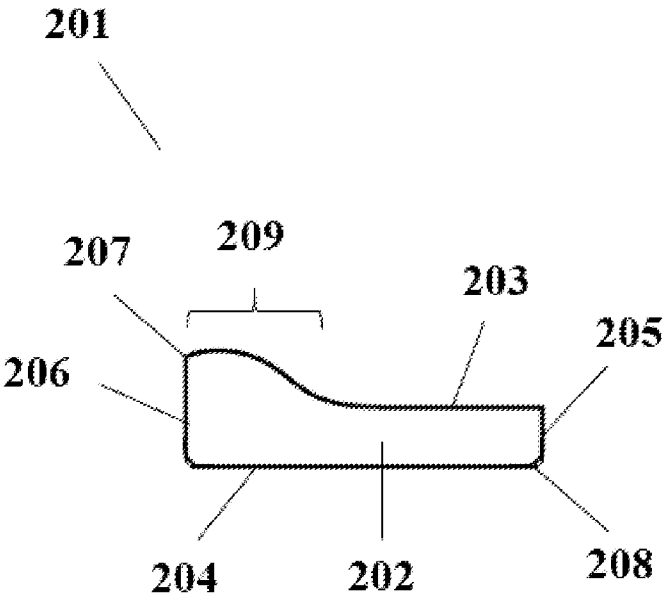
Figure 2C:
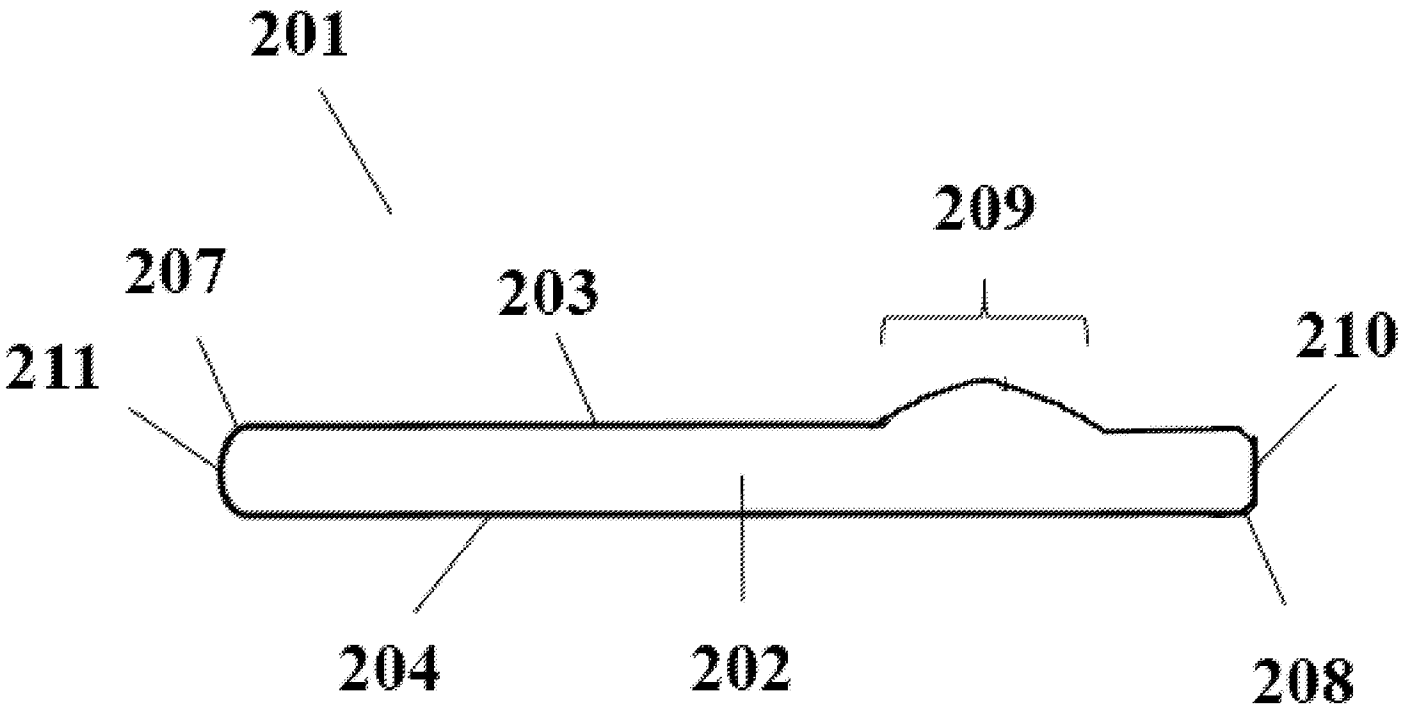

Referring to FIG. 2A-C, for example, shoe insole 201 can comprise inner sole 202, which is bounded by top surface 203, bottom surface 204, back surface 210, front surface 211, inner lateral surface 205, and outer lateral surface 206. As shown, top surface 203 is bounded by back surface 210, front surface 211, inner lateral surface 205, and outer lateral surface 206 at exterior top edge 207. As shown, bottom surface 204 is bounded by back surface 210, front surface 211, inner lateral surface 205, and outer lateral surface 206 at exterior bottom edge 208. Inner sole 202 has support portion 209, which has a thickness that is greater than the remainder of the inner sole. For example, support portion 209 can have a thickness of greater than about 1.0 cm, as detailed elsewhere herein.

Referring to FIG. 3A-M, for example, shoe insole 313 can comprise inner sole 314, which comprises forefoot interior quadrant 301, forefoot exterior quadrant 302, rearfoot interior quadrant 303, and rearfoot exterior quadrant 304. As shown, each quadrant can be further divided into an upper half and a lower half. Thus, forefoot interior quadrant 301 can be further divided into upper half 305 and lower half 306, forefoot exterior quadrant 302 can be further divided into upper half 307 and lower half 308, rearfoot interior quadrant 303 can be further divided into upper half 309 and lower half 310, and rearfoot exterior quadrant 304 can be further divided into upper half 311 and lower half 312.

Inner sole 314 can contain one or more of support portion 315, first cushioning portion 316, second cushioning portion 317, and third cushioning portion 318 (see FIG. 3B-M). Support portion 315 is located in rearfoot exterior quadrant 303. As shown, more than 50% of support portion 315 is in upper half 305; however, alternative arrangements are also envisioned. First cushioning portion 316 is located in forefoot interior quadrant 302. As shown, slightly more than 50% of first cushioning portion 316 is in upper half 307; however, alternative arrangements are also envisioned. Second cushioning portion 317 extends from forefoot interior quadrant 302 to forefoot exterior quadrant 301. As shown, nearly all (e.g., more than 70%, more than 80%, or more than 90%) of second cushioning portion 317 is located in lower halves 306 and 308, with the majority being in lower half 306; however, alternative arrangements are also envisioned. Third cushioning portion 318 is located in rearfoot interior quadrant 304 and rearfoot exterior quadrant 303. For example, as shown, approximately one-half of third cushioning portion 318 is in rearfoot interior quadrant 304 and the other approximately one-half is in rearfoot exterior portion 303, although other arrangements are also envisioned. As shown, all of third cushioning portion 318 is located in lower halves 310 and 312; however, alternative arrangements are also envisioned.

Figure 3A:
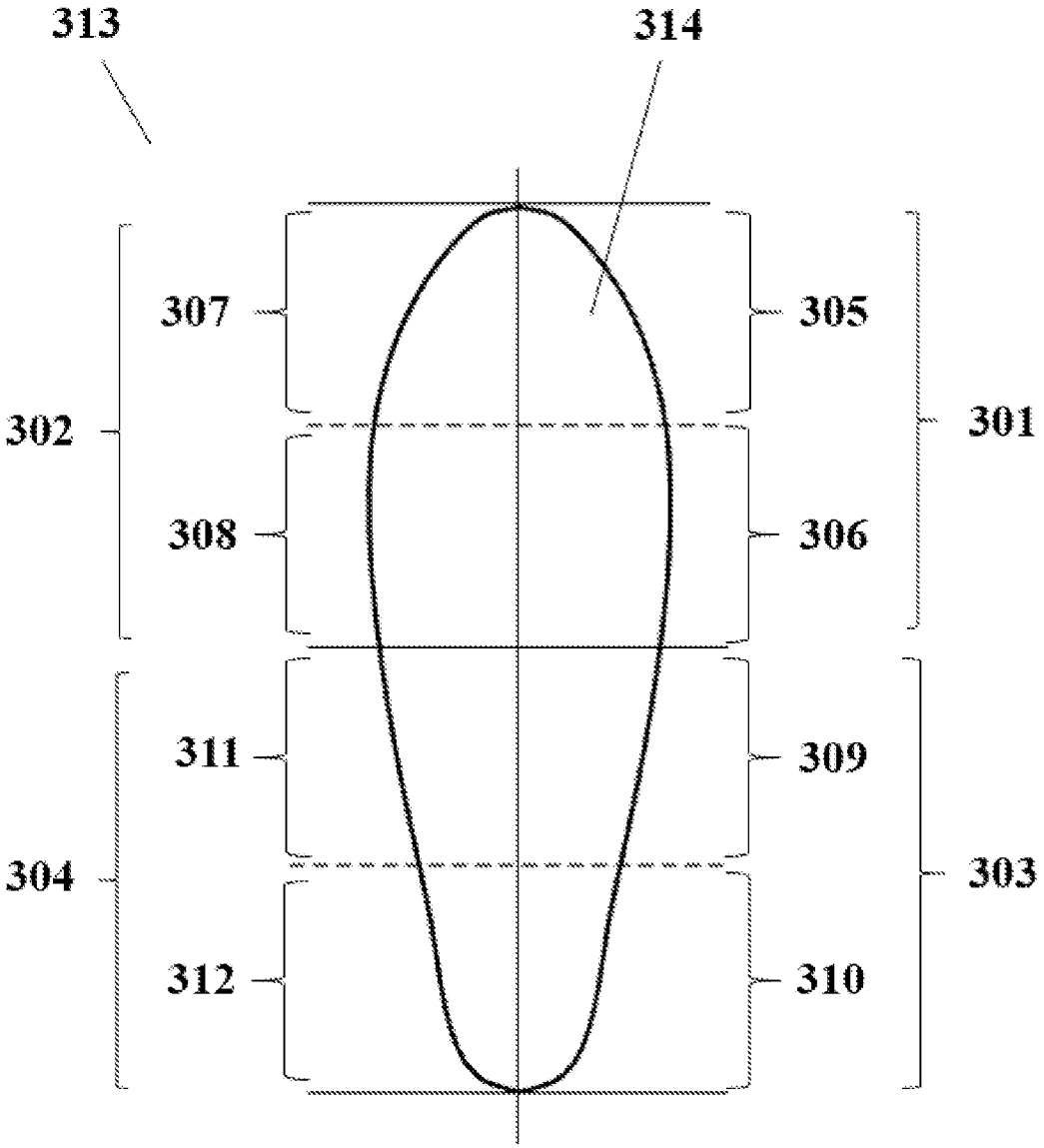
FIG. 3A-M show representative images of a shoe insole having a forefoot interior quadrant, a forefoot exterior quadran, a rearfoot interior quadrant, and a rearfoot exterior quadrant.
Figure 3B:
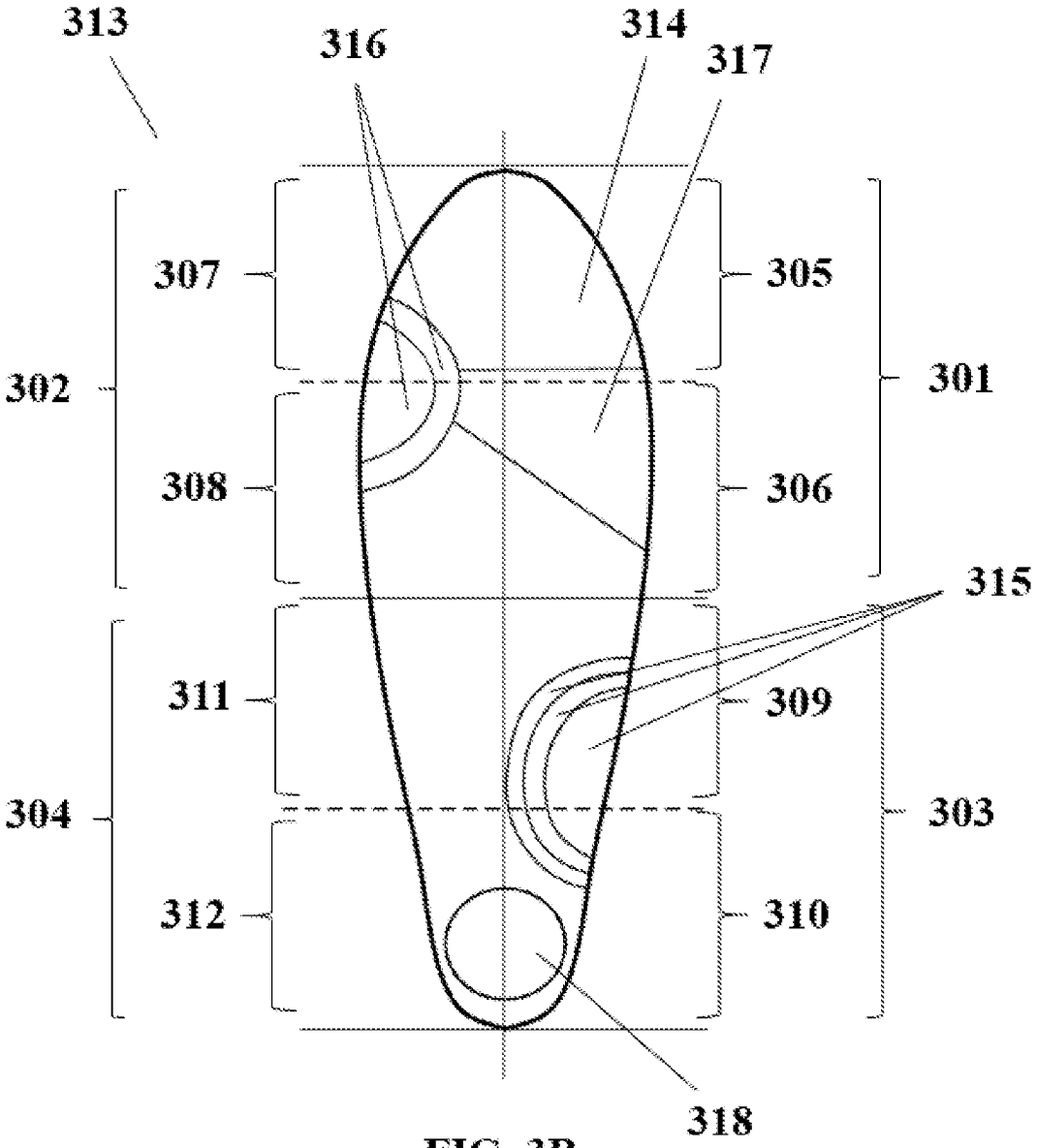
Figure 3C:
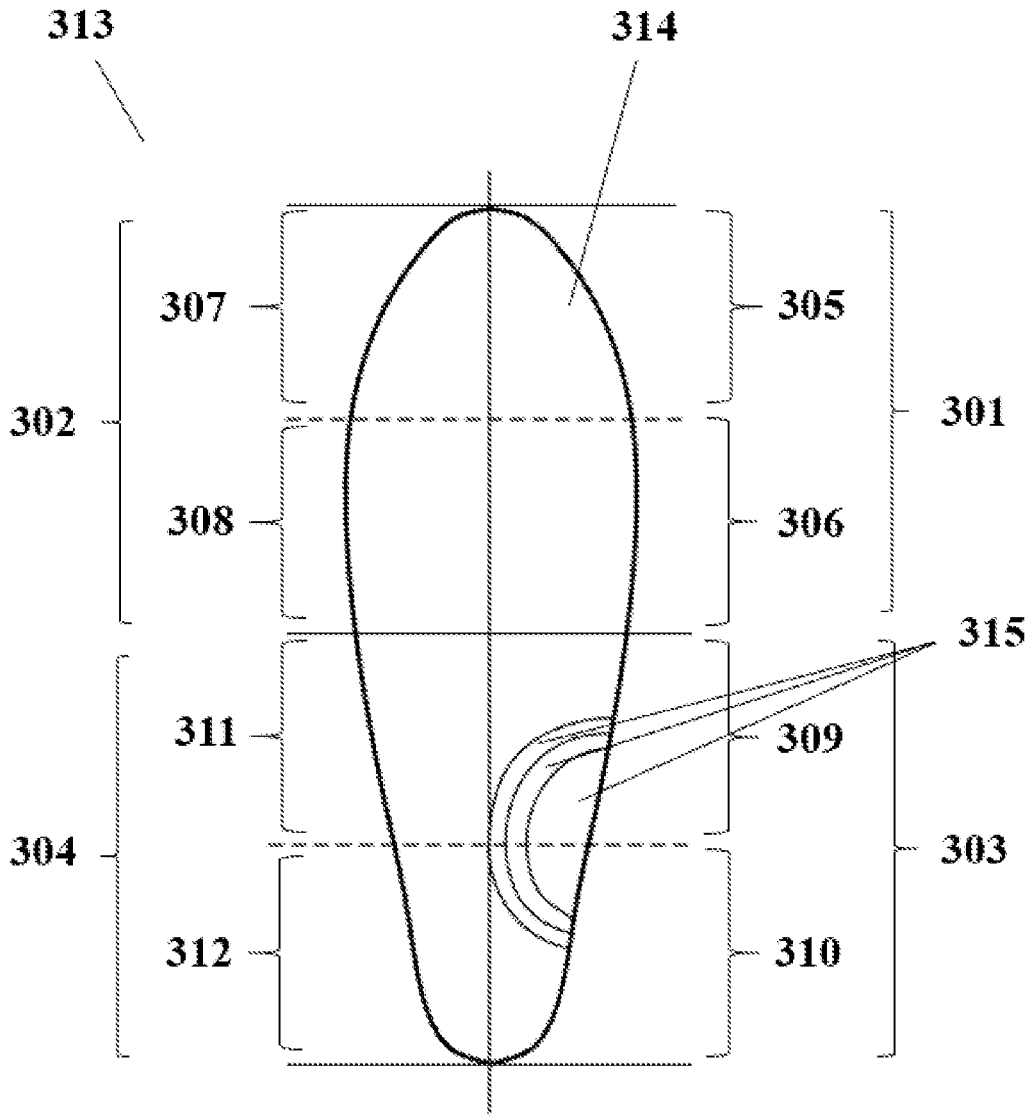
Figure 3D:
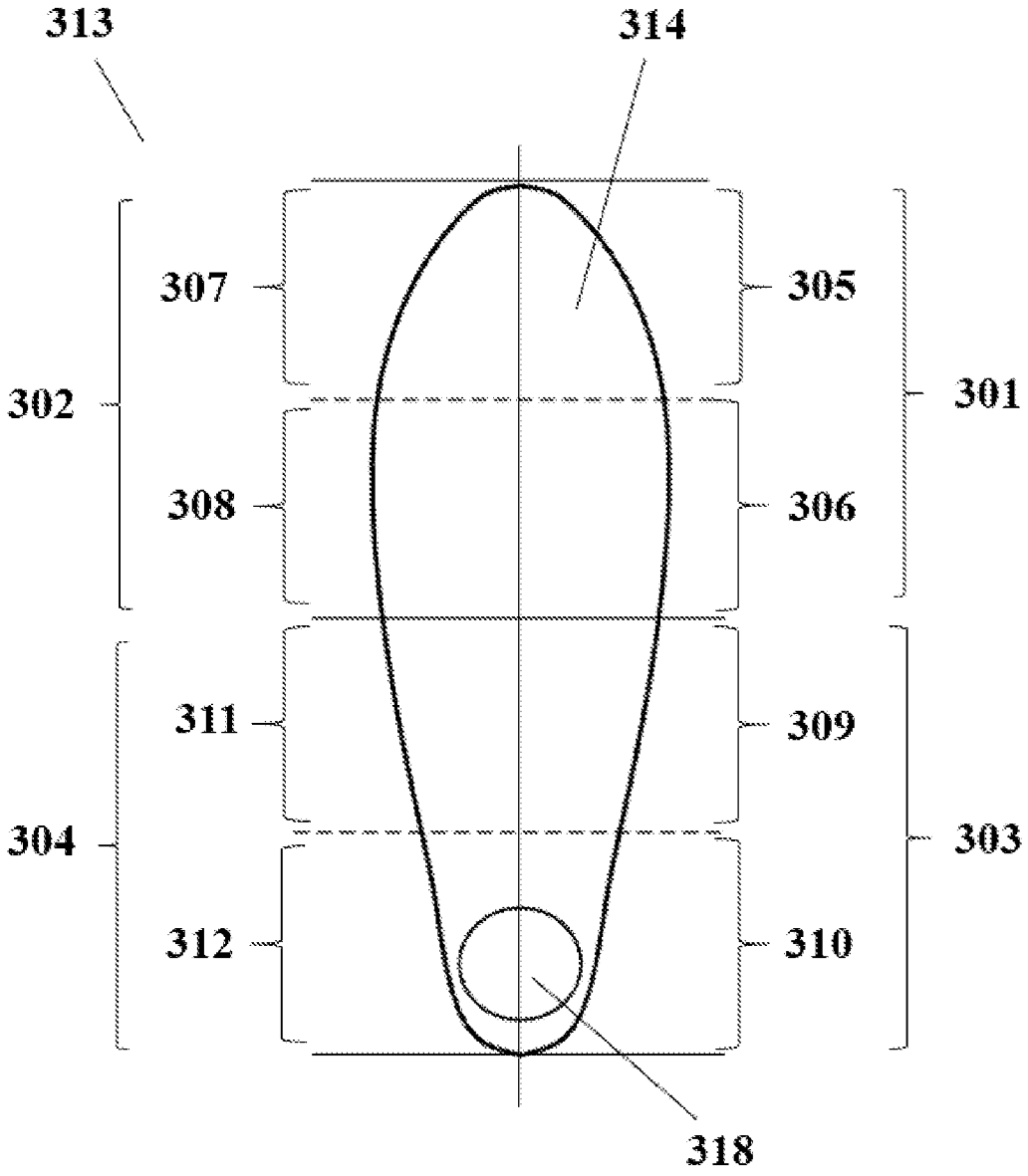
Figure 3E:
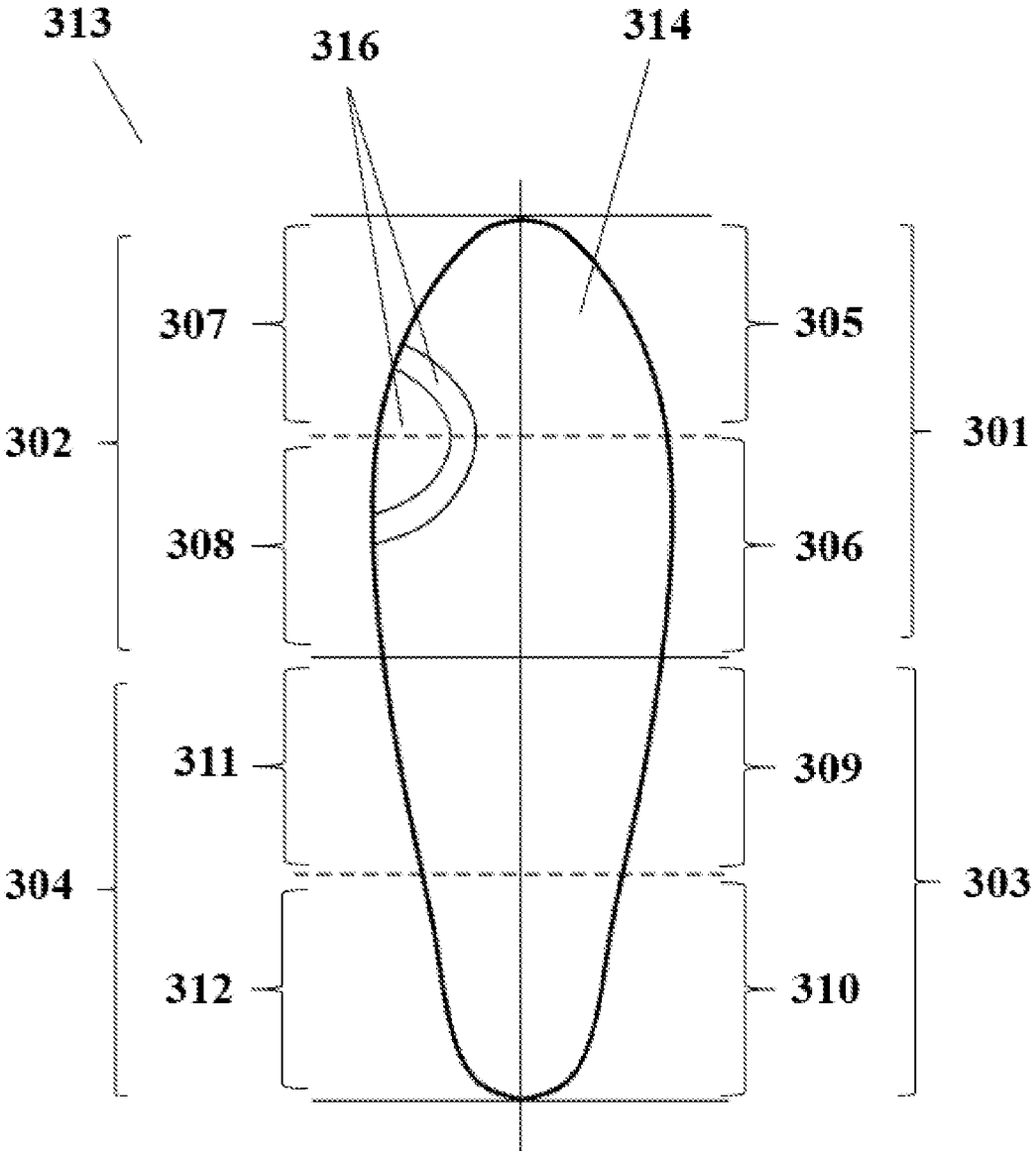
Figure 3F:
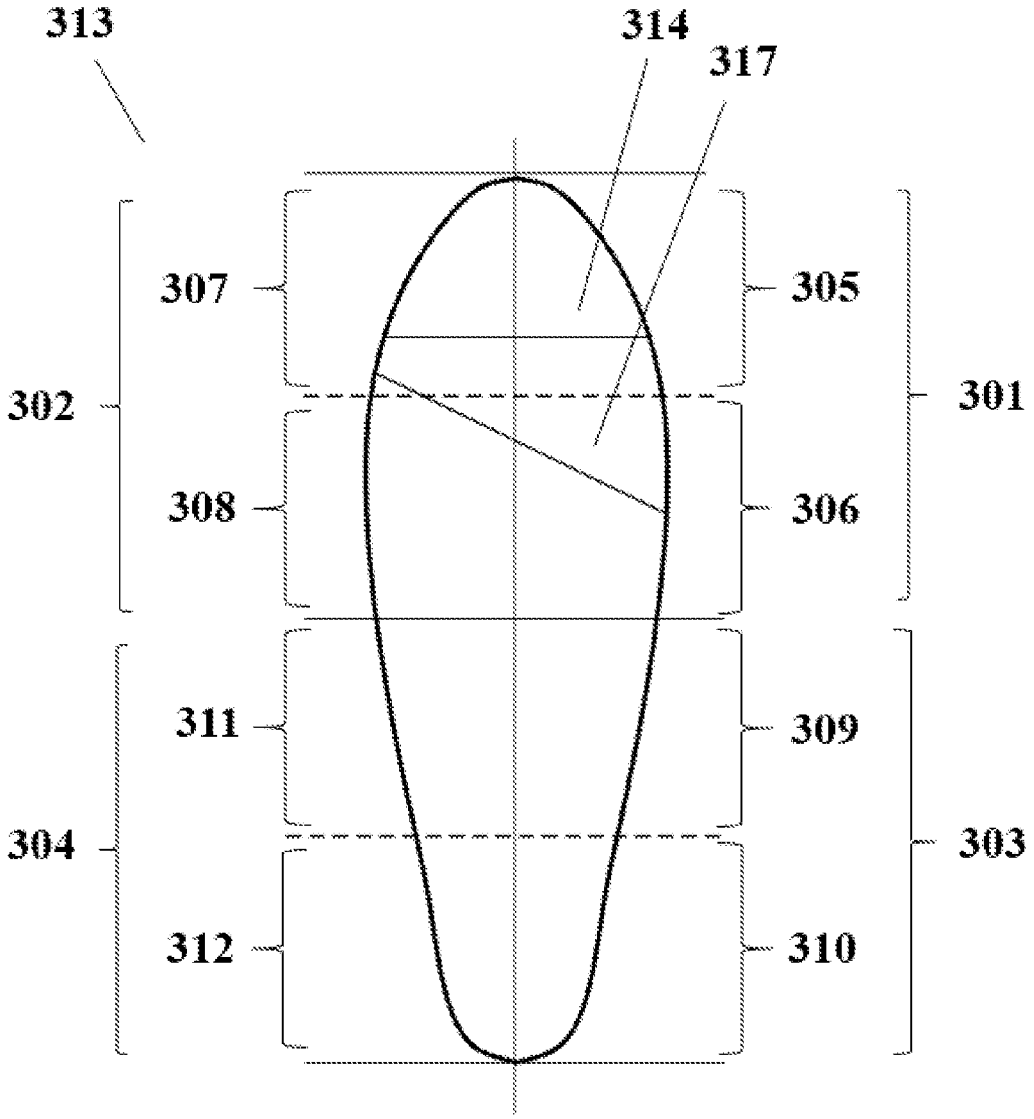
Figure 3G:
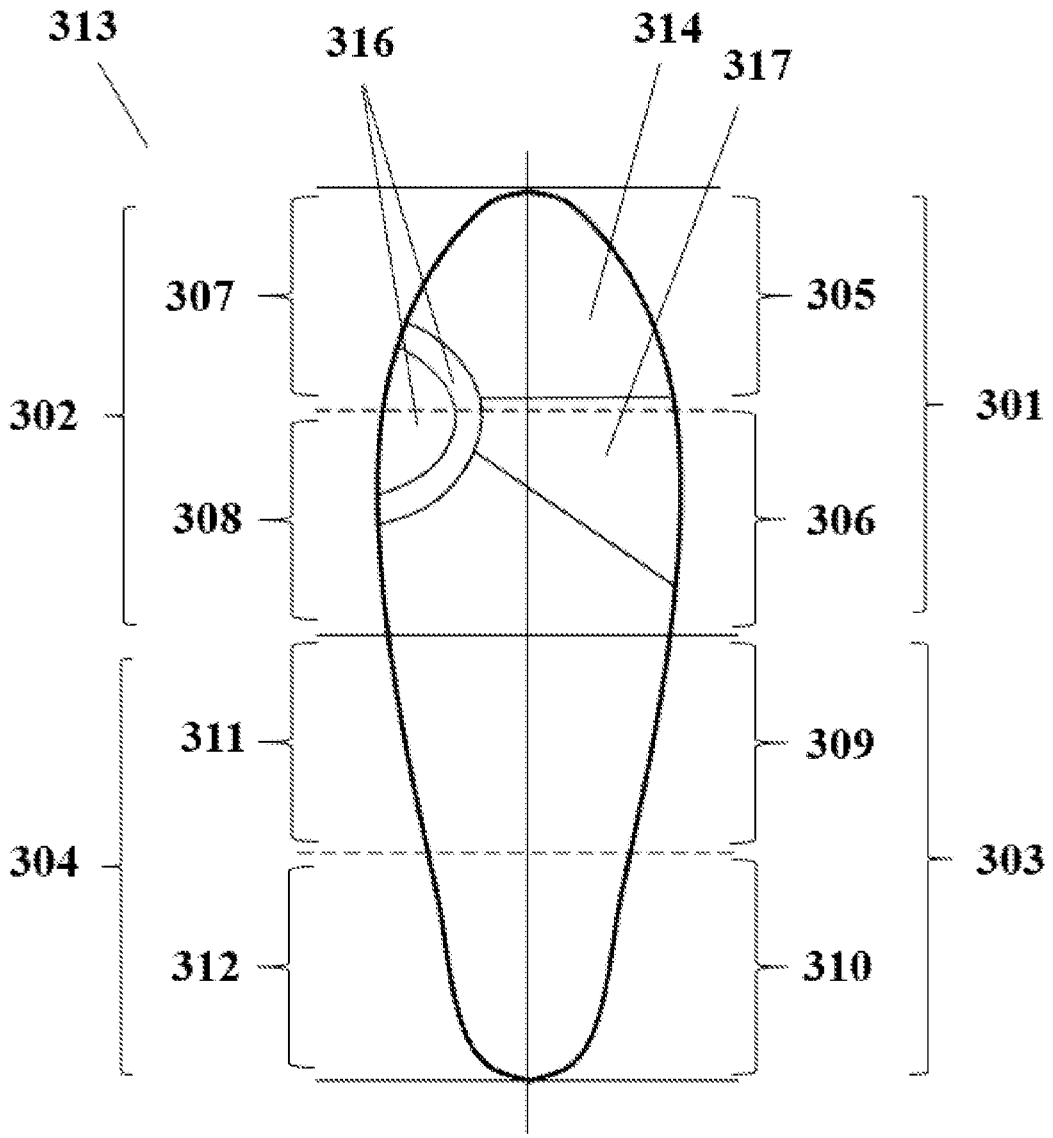
Figure 3H:
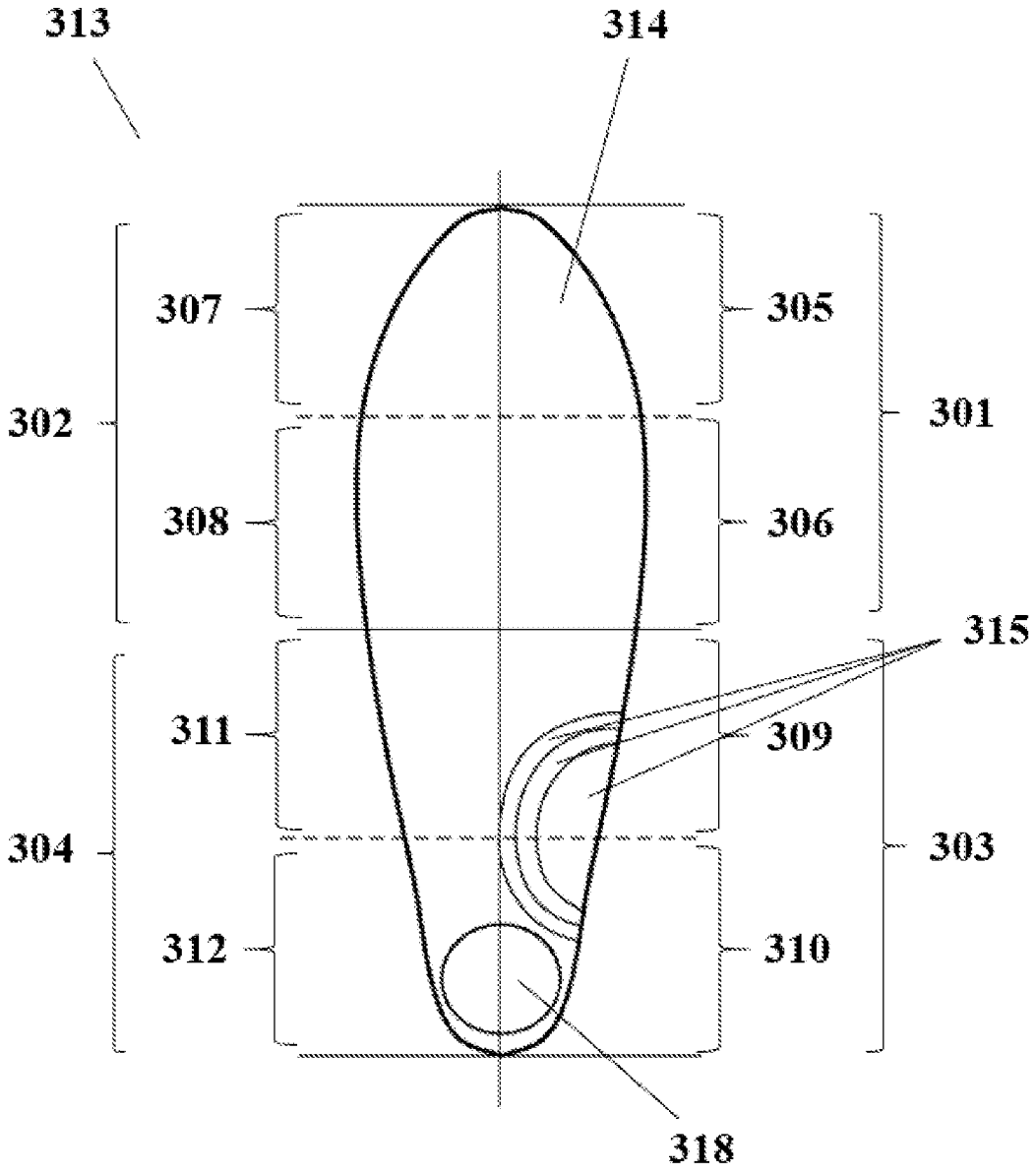
Figure 3I:
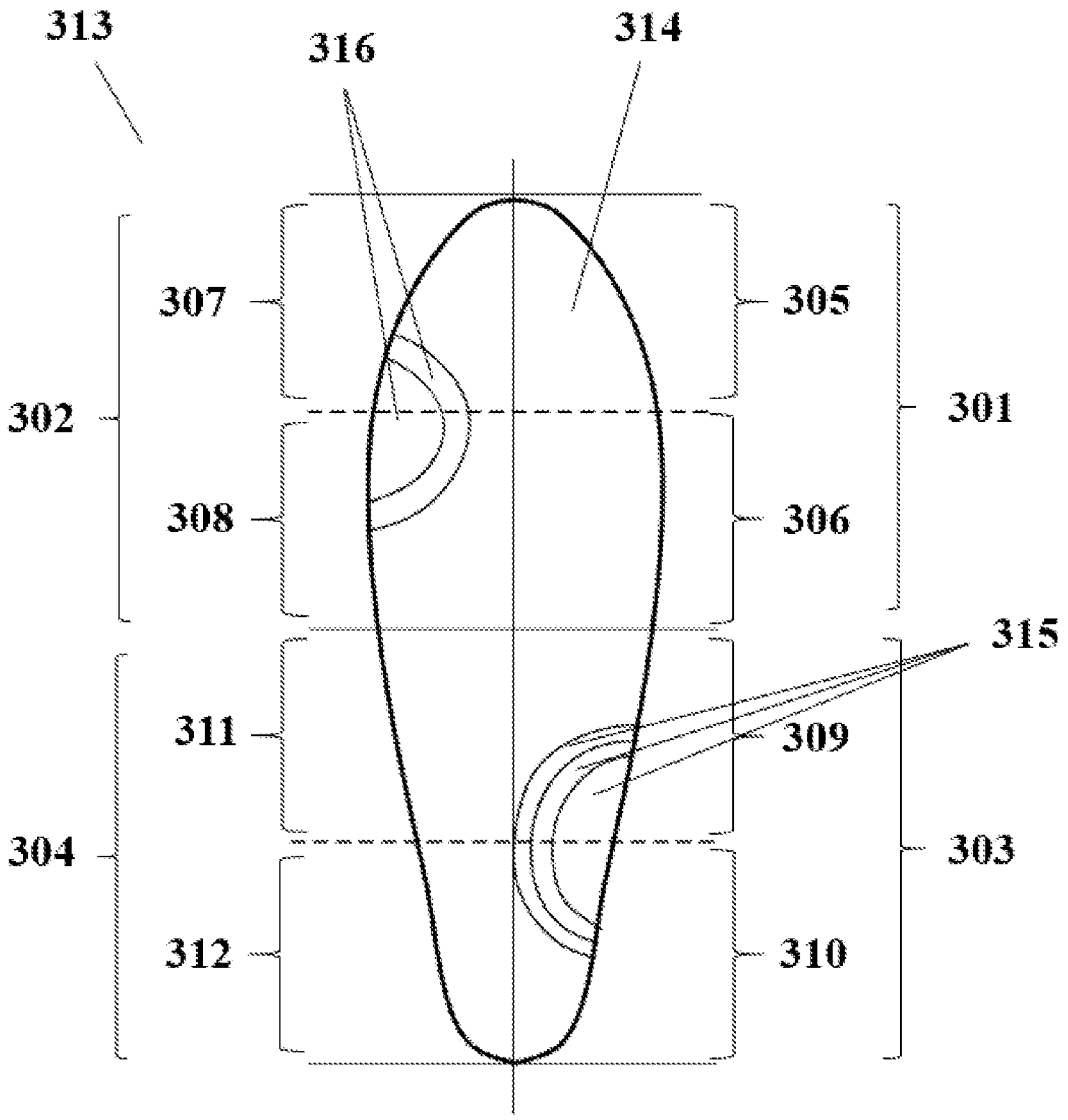
Figure 3J:
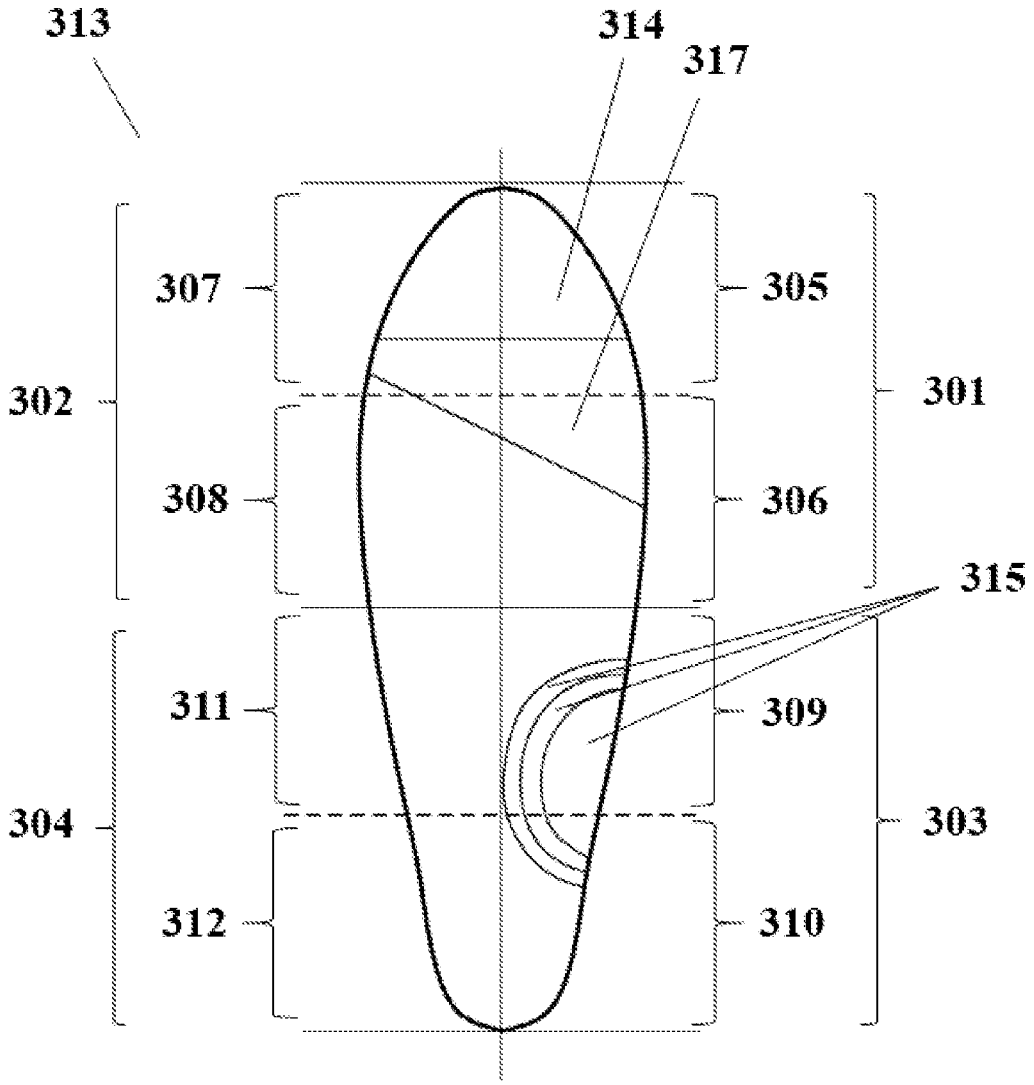
Figure 3K:
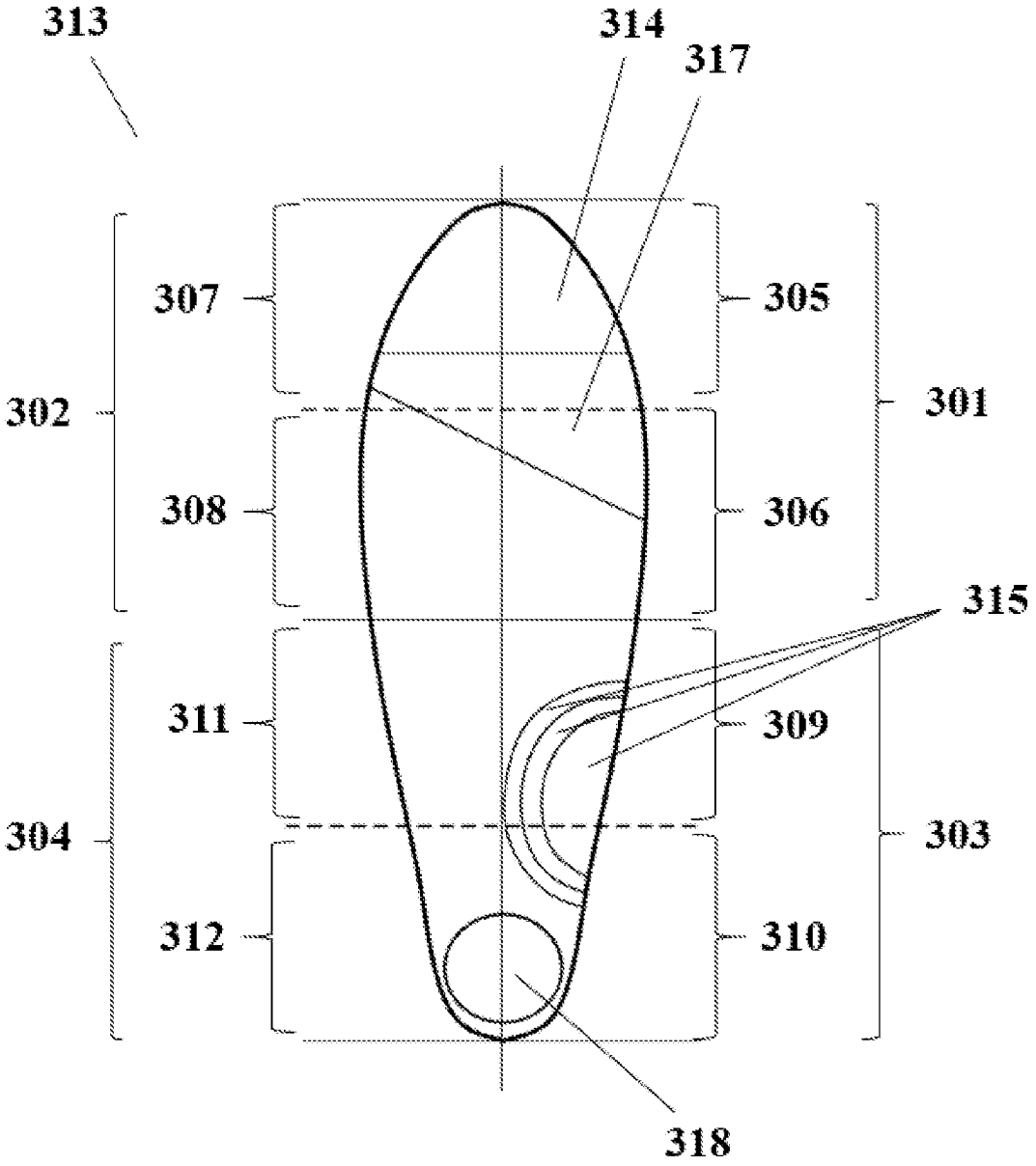
Figure 3L:
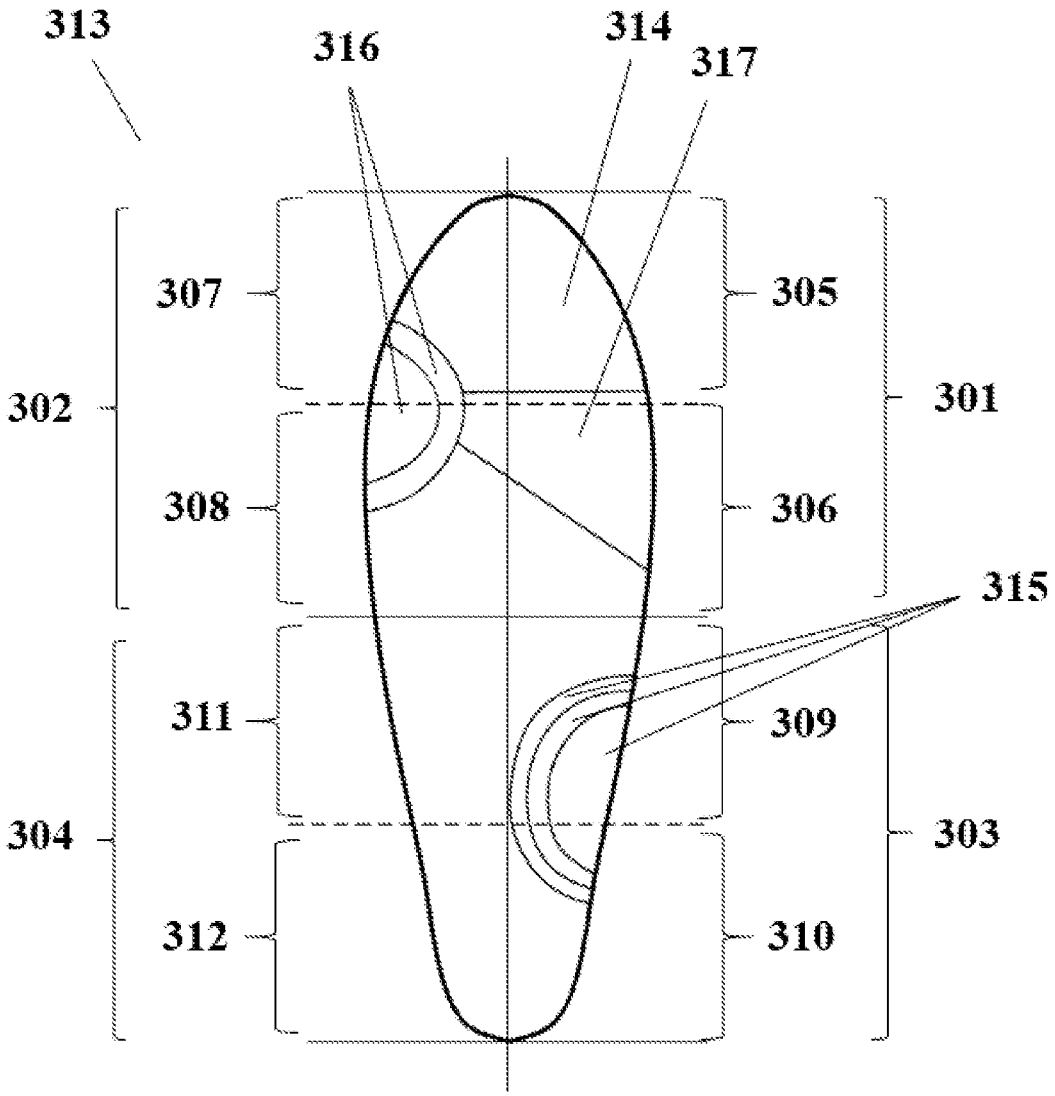
Figure 3M:
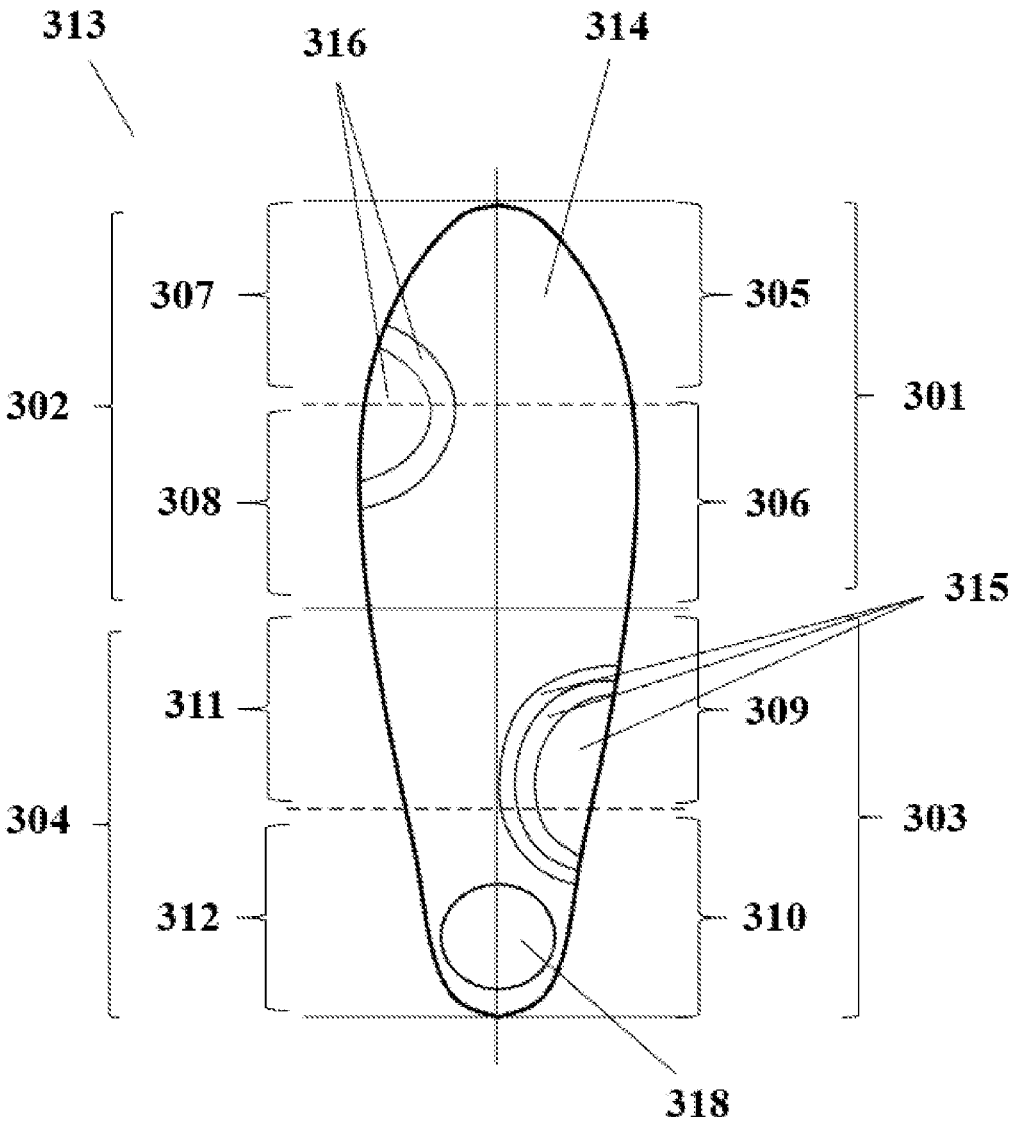

Referring to FIG. 3B, for example, inner sole 314 can contain each of support portion 315, first cushioning portion 316, second cushioning portion 317, and third cushioning portion 318. Alternatively, inner sole 314 can contain only support portion 315 (FIG. 3C), only third cushioning portion 318 (FIG. 3D), only first cushioning portion 316 (FIG. 3E), only second cushioning portion 317 (FIG. 3F), first cushioning portion 316 and second cushioning portion 317 (FIG. 3G), support portion 315 and third cushioning portion 318 (FIG. 3H), support portion 315 and first cushioning portion 316 (FIG. 3I), support portion 315 and second cushioning portion 317 (FIG. 3J), support portion 315 and second and third cushioning portions 317 and 318 (FIG. 3K), support portion 315 and first and second cushioning portions 316 and 318 (FIG. 3L), or support portion 315 and first and third cushioning portions 316 and 318 (FIG. 3M), although alternative arrangements and combinations are also envisioned.

In a further aspect, the remainder of the inner sole has a density that is the same or less than the density of the support portion. In a still further aspect, the remainder of the inner sole has a density that is the same as the density of the support portion. In yet a further aspect, the remainder of the inner sole has a density that is less than the density of the support portion. In a further aspect, the inner sole has a density of less than about 1.2 g/cm$^3$, less than about 1.0 g/cm$^3$, less than about 0.8 g/cm$^3$, less than about 0.8 g/cm$^3$, less than about 0.6 g/cm$^3$, less than about 0.4 g/cm$^3$, less than about 0.2 g/cm$^3$, or less than about 0.1 g/cm$^3$.

In a further aspect, the inner sole comprises a semi-rigid material. Examples of semi-rigid materials include, but are not limited to, nylon, polyethylene, polypropylene, and thermoplastic urethane. In a further aspect, the semi-rigid material is nylon.

In a further aspect, the inner sole comprises a gel and/or a rubber.

1. Support Portion

In one aspect, the disclosed shoe insole comprises an inner sole having a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$.

Thus, in various aspects, the support portion of the insole has a surface area of from about 12.5 cm$^2$ to about 80 cm$^2$, about 12.5 cm$^2$ to about 70 cm$^2$, about 12.5 cm$^2$ to about 60 cm$^2$, about 12.5 cm$^2$ to about 50 cm$^2$, about 12.5 cm$^2$ to about 40 cm$^2$, about 12.5 cm$^2$ to about 30 cm$^2$, about 12.5 cm$^2$ to about 20 cm$^2$, about 20 cm$^2$ to about 80 cm$^2$, about 30 cm$^2$ to about 80 cm$^2$, about 40 cm$^2$ to about 80 cm$^2$, about 50 cm$^2$ to about 80 cm$^2$, about 60 cm$^2$ to about 80 cm$^2$, about 70 cm$^2$ to about 80 cm$^2$, about 20 cm$^2$ to about 70 cm$^2$, about 30 cm$^2$ to about 60 cm$^2$, or about 40 cm$^2$ to about 50 cm$^2$. In a further aspect, the support portion of the insole has a surface area of from about 28 cm$^2$ to about 29 cm$^2$.

In various aspects, the support portion of the insole has a cross-sectional area of from about 2 cm$^2$ to about 12 cm$^2$, about 2 cm$^2$ to about 10 cm$^2$, about 2 cm$^2$ to about 8 cm$^2$, about 2 cm$^2$ to about 6 cm$^2$, about 2 cm$^2$ to about 4 cm$^2$, about 4 cm$^2$ to about 12 cm$^2$, about 6 cm$^2$ to about 12 cm$^2$, about 8 cm$^2$ to about 12 cm$^2$, about 10 cm$^2$ to about 12 cm$^2$, about 4 cm$^2$ to about 10 cm$^2$, or about 6 cm$^2$ to about 8 cm$^2$. In a further aspect, the support portion of the insole has a cross-sectional area of from about 6 cm$^2$ to about 7 cm$^2$.

In a further aspect, the thickness of the support portion is greater than the thickness of the remaining portion of the insole (i.e., the portion of the inner sole that is not made up of the support portion). In a still further aspect, the thickness of the support portion is greater than the thickness of the remaining portion of the insole, including any cushioning portion that is present (i.e., the thickness of the support portion is also greater than any cushioning portion that is present).

Without wishing to be bound by theory, the disclosed support portion can be useful in preventing supination. Supination of the foot occurs when a person's weight rolls onto the outer edges of the feet, causing the ankles to roll outwards, which can cause strain. If the mechanics of the foot are even slightly off, this can throw off the alignment of the entire body. If left untreated, this condition can lead to degenerative wear and tear and cause chronic discomfort and pain in the knees, hips, and back. This condition can also make runners and people with flexible, flat feet more prone to fatigue and overuse injuries, including shin splints, plantar fasciitis, heel spurs, metatarsalgia, post-tib tendonitis, and bunions.

In various aspects, the disclosed support portion can help to correct protonation by preventing the foot from rolling too far inward and placing excessive strain on the ankles. For example, the disclosed support portion provides additional support underneath the foot. The disclosed support portion also helps to distribute pressure across the foot.

Figure 4B:
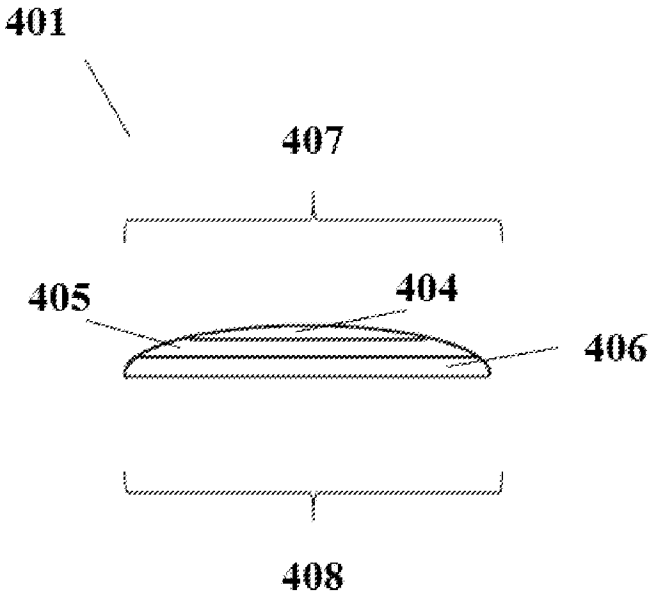
FIG. 4A-C show representative images of a top view (FIG. 4A), a side view (FIG. 4B), and a cross-sectional side view (FIG. 4C) of a support portion.
Figure 4A:
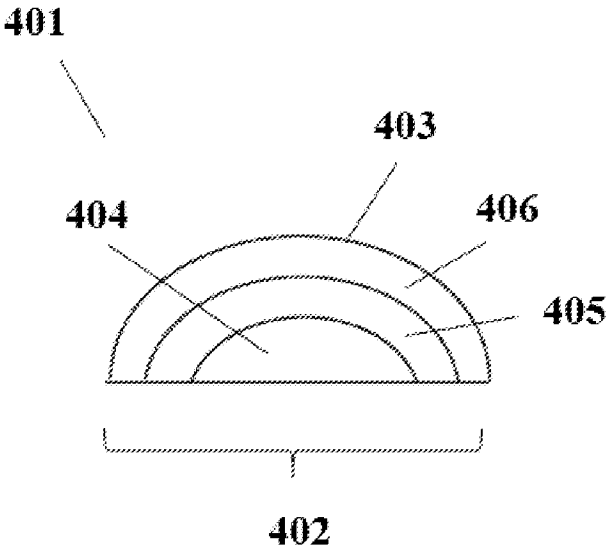
Figure 4C:
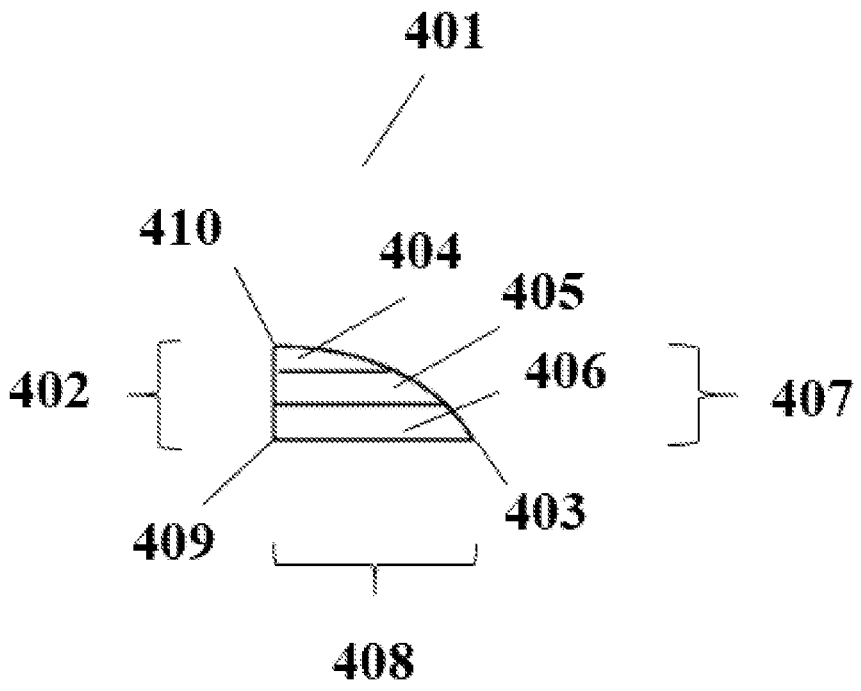

Referring to FIG. 4A-C, for example, support portion 401 is bounded by first portion of the top surface 407, first portion of the bottom surface 408, and first portion of the outer lateral surface 402. As shown in FIG. 4A, support portion 401 has a semi-ellipsoid cross-section, although alternative shapes such as, for example, a semi-circle, a semi-oval, a square, or a rectangle, are also envisioned. As shown in FIG. 4C, support portion 401 has a quarter-ellipsoid cross-section in a z-plane relative to first portion of the bottom surface 408 and first portion of the outer lateral surface 402, although alternative shapes such as, for example, a quarter-circle or a quarter-oval, are also envisioned. First portion of the bottom surface 408 extends from first portion of the bottom exterior edge 409 to first inner edge 403. As shown, first inner edge 403 is arc-shaped; however, alternative shapes such as, for example, a square-shape or a rectangle-shape, are also envisioned. As shown, first portion of the exterior bottom edge 409 is substantially linear, although alternative shapes are also envisioned. First portion of the outer lateral surface 402 extends from first portion of the exterior bottom edge 409 to first portion of the exterior top edge 410. Support portion 401 can be made up of a plurality of layers such as, for example, two, three, or four layers. Thus, as shown, support portion 401 is made up of first layer 406, second layer 405, and third layer 407. As shown, first portion of the bottom surface 48 is formed only by first layer 406 and first portion of the outer lateral surface 402 is formed by a first lateral portion of layers 406, 407, and 408; however, alternative arrangements are also envisioned. The thickness of each layer can vary, as detailed elsewhere herein.

In a further aspect, the support portion has a thickness of greater than about 1.0 cm, about 1.3 cm, about 1.5 cm, about 1.7 cm, about 1.9 cm, about 2.0 cm, or greater than about 2.1 cm. In a still further aspect, the support portion has a thickness of greater than about 2.0 cm.

In a further aspect, the support portion has a thickness of from about 1.1 cm to about 2.5 cm, about 1.1 cm to about 2.0 cm, about 1.1 cm to about 1.5 cm, about 1.5 cm to about 2.5 cm, about 2.0 cm to about 2.5 cm, or about 1.5 cm to about 2.0 cm. In a still further aspect, the support portion has a thickness of about 2.2 cm.

In various aspects, a first region of the support portion comprises a material that is the same as that used in the remainder of the inner sole. The first region can have a thickness of, for example, from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 0.9 cm to about 1.2 cm, about 1.0 cm to about 1.2 cm, about 1.1 cm to about 1.2 cm, or about 0.9 cm to about 1.1 cm. In a further aspect, the first region has a thickness of about 1.0 cm.

In various aspects, a second region of the support portion comprises a material that is different than that used in the remainder of the inner sole. For example, the material of the second region can have a different density and/or durometer than the material used in the remainder of the inner sole. The second region can have a thickness of, for example, from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 0.9 cm to about 1.2 cm, about 1.0 cm to about 1.2 cm, about 1.1 cm to about 1.2 cm, or about 0.9 cm to about 1.1 cm. In a still further aspect, the second region has a thickness of about 1.2 cm.

In various aspects, the second region of the support portion has a surface area of from about 12.5 $cm^2$ to about 80 $cm^2$, about 12.5 $cm^2$ to about 70 $cm^2$, about 12.5 $cm^2$ to about 60 $cm^2$, about 12.5 $cm^2$ to about 50 $cm^2$, about 12.5 $cm^2$ to about 40 $cm^2$, about 12.5 $cm^2$ to about 30 $cm^2$, about 12.5 $cm^2$ to about 20 $cm^2$, about 20 $cm^2$ to about 80 $cm^2$, about 30 $cm^2$ to about 80 $cm^2$, about 40 $cm^2$ to about 80 $cm^2$, about 50 $cm^2$ to about 80 $cm^2$, about 60 $cm^2$ to about 80 $cm^2$, about 70 $cm^2$ to about 80 $cm^2$, about 20 $cm^2$ to about 70 $cm^2$, about 30 $cm^2$ to about 60 $cm^2$, or about 40 $cm^2$ to about 50 $cm^2$. In a further aspect, the second region of the support portion has a surface area of from about 22 $cm^2$ to about 23 $cm^2$.

In various aspects, the second region of the support portion has a cross-sectional area of from about 2 $cm^2$ to about 10 $cm^2$, about 2 $cm^2$ to about 8 $cm^2$, about 2 $cm^2$ to about 6 $cm^2$, about 2 $cm^2$ to about 4 $cm^2$, about 4 $cm^2$ to about 12 $cm^2$, about 6 $cm^2$ to about 12 $cm^2$, about 8 $cm^2$ to about 12 $cm^2$, about 10 $cm^2$ to about 12 $cm^2$, about 4 $cm^2$ to about 10 $cm^2$, or about 6 $cm^2$ to about 8 $cm^2$. In a further aspect, the second region of the support portion has a cross-sectional area of from about 3 $cm^2$ to about 4 $cm^2$.

In a further aspect, the support portion is a protrusion such as, for example, a curved protrusion. In a still further aspect, the curved protrusion is shaped as a semi-sphere or a quarter sphere. In yet a further aspect, the curved protrusion is shaped as a quarter sphere.

In various aspects, the protrusion has a surface area of from about 12.5 $cm^2$ to about 80 $cm^2$, about 12.5 $cm^2$ to about 70 $cm^2$, about 12.5 $cm^2$ to about 60 $cm^2$, about 12.5 $cm^2$ to about 50 $cm^2$, about 12.5 $cm^2$ to about 40 $cm^2$, about 12.5 $cm^2$ to about 30 $cm^2$, about 12.5 $cm^2$ to about 20 $cm^2$, about 20 $cm^2$ to about 80 $cm^2$, about 30 $cm^2$ to about 80 $cm^2$, about 40 $cm^2$ to about 80 $cm^2$, about 50 $cm^2$ to about 80 $cm^2$, about 60 $cm^2$ to about 80 $cm^2$, about 70 $cm^2$ to about 80 $cm^2$, about 20 $cm^2$ to about 70 $cm^2$, about 30 $cm^2$ to about 60 $cm^2$, or about 40 $cm^2$ to about 50 $cm^2$. In a further aspect, the second region of the support portion has a surface area of from about 22 $cm^2$ to about 23 $cm^2$.

In various aspects, the protrusion has a cross-sectional area of from about 2 $cm^2$ to about 10 $cm^2$, about 2 $cm^2$ to about 8 $cm^2$, about 2 $cm^2$ to about 6 $cm^2$, about 2 $cm^2$ to about 4 $cm^2$, about 4 $cm^2$ to about 12 $cm^2$, about 6 $cm^2$ to about 12 $cm^2$, about 8 $cm^2$ to about 12 $cm^2$, about 10 $cm^2$ to about 12 $cm^2$, about 4 $cm^2$ to about 10 $cm^2$, or about 6 $cm^2$ to about 8 $cm^2$ in a z-plane relative to the bottom surface and the outer lateral surface. In a further aspect, the second region of the support portion has a cross-sectional area of from about 3 $cm^2$ to about 4 $cm^2$ in a z-plane relative to the bottom surface and the outer lateral surface.

In various aspects, the protrusion has a cross-sectional area of from about 2 $cm^2$ to about 10 $cm^2$, about 2 $cm^2$ to about 8 $cm^2$, about 2 $cm^2$ to about 6 $cm^2$, about 2 $cm^2$ to about 4 $cm^2$, about 4 $cm^2$ to about 12 $cm^2$, about 6 $cm^2$ to about 12 $cm^2$, about 8 $cm^2$ to about 12 $cm^2$, about 10 $cm^2$ to about 12 $cm^2$, about 4 $cm^2$ to about 10 $cm^2$, or about 6 $cm^2$ to about 8 $cm^2$ in a y-plane relative to the bottom surface and the outer lateral surface. In a further aspect, the second region of the support portion has a cross-sectional area of from about 6 $cm^2$ to about 7 $cm^2$ in a y-plane relative to the bottom surface and the outer lateral surface.

In a further aspect, at least 30%, at least 40%, at least 50%, at least 60%, or at least 70% of the support portion is in an upper half of the rearfoot exterior quadrant. In a still further aspect, at least 50% of the support portion is in an upper half of the rearfoot exterior quadrant. In yet a further aspect, more than 50% of the support portion is in an upper half of the rearfoot exterior quadrant.

In a further aspect, the support portion is bounded by a first portion of the top surface, a first portion of the bottom surface, and a first portion of the outer lateral surface. In a still further aspect, the support portion has a quarter-circle cross-section in a z-plane relative to the first portion of the bottom surface and the first portion of the outer lateral surface. In yet a further aspect, the support portion has a quarter-oval cross-section in a z-plane relative to the first portion of the bottom surface and the first portion of the outer lateral surface. In an even further aspect, the support portion has a quarter-ellipsoid cross-section in a z-plane relative to the first portion of the bottom surface and the first portion of the outer lateral surface.

In a further aspect, the first portion of the bottom surface extends from a first portion of the exterior bottom edge to a first inner edge. In a still further aspect, the first inner edge is substantially linear. In yet a further aspect, the first inner edge is arc-shaped.

In a further aspect, the first portion of the bottom surface has a semi-circular cross-section. In a still further aspect, the first portion of the bottom surface has a semi-oval cross-section. In yet a further aspect, the first portion of the bottom surface has a semi-ellipsoid cross-section.

In a further aspect, the first inner edge extends to a maximum distance of from about 2.5 cm to about 5.1 cm, about 2.5 cm to about 5.0 cm, about 2.5 cm to about 4.5 cm, about 2.5 cm to about 4.0 cm, about 2.5 cm to about 3.5 cm, about 2.5 cm to about 3.0 cm, about 3.0 cm to about 5.1 cm, about 3.5 cm to about 5.1 cm, about 4.0 cm to about 5.1 cm, about 4.5 cm to about 5.1 cm, about 3.0 cm to about 5.0 cm, or about 3.5 cm to about 4.5 cm from the first portion of the outer lateral surface. In a still further aspect, the first inner edge extends to a maximum distance of about 3.8 cm from the first portion of the outer lateral surface.

In a further aspect, the first portion of the exterior bottom edge is substantially linear.

In a further aspect, the first portion of the bottom surface extends to a maximum distance of from about 2.5 cm to about 5.1 cm, about 2.5 cm to about 5.0 cm, about 2.5 cm to about 4.5 cm, about 2.5 cm to about 4.0 cm, about 2.5 cm to about 3.5 cm, about 2.5 cm to about 3.0 cm, about 3.0 cm to about 5.1 cm, about 3.5 cm to about 5.1 cm, about 4.0 cm to about 5.1 cm, about 4.5 cm to about 5.1 cm, about 3.0 cm to about 5.0 cm, or about 3.5 cm to about 4.5 cm from the first portion of the exterior bottom edge. In a still further aspect, the first portion of the bottom surface extends to a maximum distance of about 3.3 cm from the first portion of the exterior bottom edge.

In a further aspect, the first portion of the exterior bottom edge has a length of from about 5.0 cm to about 8.9 cm, about 5.0 cm to about 8.5 cm, about 5.0 cm to about 8.0 cm, about 5.0 cm to about 7.5 cm, about 5.0 cm to about 7.0 cm, about 5.0 cm to about 6.5 cm, about 5.0 cm to about 6.0 cm, about 5.0 cm to about 5.5 cm, about 5.5 cm to about 8.9 cm, about 6.0 cm to about 8.9 cm, about 6.5 cm to about 8.9 cm, about 7.0 cm to about 8.9 cm, about 7.5 cm to about 8.9 cm, about 8.0 cm to about 8.9 cm, about 8.5 cm to about 8.9 cm, about 5.5 cm to about 8.5 cm, about 6.0 cm to about 8.0 cm, or about 6.5 cm to about 7.5 cm. In a still further aspect, the first portion of the exterior bottom edge has a length of about 7.1 cm.

In a further aspect, the first portion of the top surface is a maximum distance of from about 0.76 cm to about 1.8 cm, about 0.76 cm to about 1.5 cm, about 0.76 cm to about 1.3 cm, about 0.76 cm to about 1.1 cm, about 0.76 cm to about 0.9 cm, about 0.8 cm to about 1.8 cm, about 1.0 cm to about 1.8 cm, about 1.2 cm to about 1.8 cm, about 1.4 cm to about 1.8 cm, about 1.6 cm to about 1.8 cm, about 0.8 cm to about 1.5 cm, or about 1.0 cm to about 1.3 cm from the first portion of the bottom surface. In a still further aspect, wherein the first portion of the top surface is a maximum distance of about 1.2 cm from the first portion of the bottom surface.

In a further aspect, the first portion of the top surface is a maximum distance of from about 1.2 cm to about 3.2 cm, about 1.2 cm to about 3.0 cm, about 1.2 cm to about 2.8 cm, about 1.2 cm to about 2.6 cm, about 1.2 cm to about 2.4 cm, about 1.2 cm to about 2.2 cm, about 1.2 cm to about 2.0 cm, about 1.2 cm to about 1.8 cm, about 1.2 to about 1.6 cm, about 1.4 cm to about 3.2 cm, about 1.6 cm to about 3.2 cm, about 1.8 cm to about 3.2 cm, about 2.0 cm to about 3.2 cm, about 2.2 cm to about 3.2 cm, about 2.4 cm to about 3.2 cm, about 2.6 cm to about 3.2 cm, about 2.8 cm to about 3.2 cm, about 1.4 cm to about 3.0 cm, about 1.6 cm to about 2.8 cm, about 1.8 cm to about 2.6 cm, or about 2.0 cm to about 2.4 cm from the first portion of the bottom surface. In a still further aspect, the first portion of the top surface is a maximum distance of about 2.2 cm from the first portion of the bottom surface.

In a further aspect, the first portion of the outer lateral surface extends from a first portion of the exterior bottom edge to a first portion of the exterior top edge.

In a further aspect, the first portion of the exterior top edge is of from about 0.76 cm to about 1.8 cm, about 0.76 cm to about 1.5 cm, about 0.76 cm to about 1.3 cm, about 0.76 cm to about 1.1 cm, about 0.76 cm to about 0.9 cm, about 0.8 cm to about 1.8 cm, about 1.0 cm to about 1.8 cm, about 1.2 cm to about 1.8 cm, about 1.4 cm to about 1.8 cm, about 1.6 cm to about 1.8 cm, about 0.8 cm to about 1.5 cm, or about 1.0 cm to about 1.3 cm from the first portion of the bottom surface. In a still further aspect, the first portion of the exterior top edge is of about 1.2 cm from the first portion of the bottom surface.

In a further aspect, the first portion of the exterior top edge is of from about 1.2 cm to about 3.2 cm, about 1.2 cm to about 3.0 cm, about 1.2 cm to about 2.8 cm, about 1.2 cm to about 2.6 cm, about 1.2 cm to about 2.4 cm, about 1.2 cm to about 2.2 cm, about 1.2 cm to about 2.0 cm, about 1.2 cm to about 1.8 cm, about 1.2 to about 1.6 cm, about 1.4 cm to about 3.2 cm, about 1.6 cm to about 3.2 cm, about 1.8 cm to about 3.2 cm, about 2.0 cm to about 3.2 cm, about 2.2 cm to about 3.2 cm, about 2.4 cm to about 3.2 cm, about 2.6 cm to about 3.2 cm, about 2.8 cm to about 3.2 cm, about 1.4 cm to about 3.0 cm, about 1.6 cm to about 2.8 cm, about 1.8 cm to about 2.6 cm, or about 2.0 cm to about 2.4 cm from the first portion of the bottom surface. In a still further aspect, the first portion of the exterior top edge is of about 2.2 cm from the first portion of the bottom surface.

In a further aspect, the first portion of the outer lateral surface extends to a maximum distance of from about 0.63 cm to about 1.9 cm, about 0.63 cm to about 1.7 cm, about 0.63 cm to about 1.5 cm, about 0.63 cm to about 1.3 cm, about 0.63 cm to about 1.1 cm, about 0.63 cm to about 0.9 cm, about 0.63 cm to about 0.7 cm, about 0.7 cm to about 1.9 cm, about 0.9 cm to about 1.9 cm, about 1.1 cm to about 1.9 cm, about 1.3 cm to about 1.9 cm, about 1.5 cm to about 1.9 cm, about 1.7 cm to about 1.9 cm, about 0.7 cm to about 1.7 cm, about 0.9 cm to about 1.5 cm, or about 1.1 cm to about 1.3 cm from the first portion of the exterior bottom edge. In a still further aspect, the first portion of the outer lateral surface extends to a maximum distance of about 1.2 cm from the first portion of the exterior bottom edge.

In a further aspect, the first portion of the outer lateral surface extends to a maximum distance of from about 1.2 cm to about 3.2 cm, about 1.2 cm to about 3.0 cm, about 1.2 cm to about 2.8 cm, about 1.2 cm to about 2.6 cm, about 1.2 cm to about 2.4 cm, about 1.2 cm to about 2.2 cm, about 1.2 cm to about 2.0 cm, about 1.2 cm to about 1.8 cm, about 1.2 to about 1.6 cm, about 1.4 cm to about 3.2 cm, about 1.6 cm to about 3.2 cm, about 1.8 cm to about 3.2 cm, about 2.0 cm to about 3.2 cm, about 2.2 cm to about 3.2 cm, about 2.4 cm to about 3.2 cm, about 2.6 cm to about 3.2 cm, about 2.8 cm to about 3.2 cm, about 1.4 cm to about 3.0 cm, about 1.6 cm to about 2.8 cm, about 1.8 cm to about 2.6 cm, or about 2.0 cm to about 2.4 cm from the first portion of the exterior bottom edge. In a still further aspect, the first portion of the outer lateral surface extends to a maximum distance of about 2.2 cm from the first portion of the exterior bottom edge.

In a further aspect, the first portion of the bottom surface is substantially perpendicular to the first portion of the outer lateral surface.

In a further aspect, the support portion comprises a plurality of layers. In a still further aspect, the support portion is bounded by a first portion of a top surface, a first portion of a bottom surface, and a first portion of an outer lateral surface. In yet a further aspect, the first portion of the bottom surface is formed by only one layer. In an even further aspect, the first portion of the outer lateral surface is formed by a first lateral portion of more than one layer.

In a further aspect, the support portion comprises two layers.

In a further aspect, the support portion comprises three layers. In a still further aspect, the support portion is bounded by a first portion of a top surface, a first portion of a bottom surface, and a first portion of an outer lateral surface. In yet a further aspect, the first portion of the bottom surface is formed by only one layer. In an even further aspect, the first portion of the outer lateral surface is formed by a first lateral portion of all three layers.

In a further aspect, at least one of the layers comprise a medical grade foam. Examples of medical grade foam include, but are not limited to, ethylene vinyl acetate (EVA) foam, polyurethane foam, and polyethylene foam. In a still further aspect, each of the layers comprise a medical grade foam. In yet a further aspect, each of the layers comprise a different medical grade foam.

In a further aspect, each layer has a different durometer. In a still further aspect, each layer has a durometer of from about 15 N to about 80 N, about 15 N to about 75 N, about 15 N to about 70 N, about 15 N to about 65 N, about 15 N to about 60 N, about 15 N to about 55 N, about 15 N to about 50 N, about 15 N to about 45 N, about 15 N to about 40 N, about 15 N to about 35 N, about 15 N to about 30 N, about 15 N to about 25 N, about 15 N to about 20 N, about 20 N to about 80 N, about 25 N to about 80 N, about 30 N to about 80 N, about 35 N to about 80 N, about 40 N to about 80 N, about 45 N to about 80 N, about 50 N to about 80 N, about 55 N to about 80 N, about 60 N to about 80 N, about 65 N to about 80 N, about 70 N to about 80 N, about 75 N to about 80 N, about 20 N to about 75 N, about 25 N to about 70 N, about 30 N to about 65 N, about 35 N to about 60 N, about 40 N to about 55 N, or about 45 N to about 50 N.

In a further aspect, each layer has a different thickness. In a still further aspect, each layer has a thickness of from about 0.16 cm to about 0.64 cm, about 0.16 cm to about 0.60 cm, about 0.16 cm to about 0.55 cm, about 0.16 cm to about 0.50 cm, about 0.16 cm to about 0.45 cm, about 0.16 cm to about 0.40 cm, about 0.16 cm to about 0.35 cm, about 0.16 cm to about 0.30 cm, about 0.16 cm to about 0.25 cm, about 0.16 cm to about 0.20 cm, about 0.20 cm to about 0.64 cm, about 0.25 cm to about 0.64 cm, about 0.30 cm to about 0.64 cm, about 0.35 cm to about 0.64 cm, about 0.40 cm to about 0.64 cm, about 0.45 cm to about 0.64 cm, about 0.50 cm to about 0.64 cm, about 0.60 cm to about 0.64 cm, about 0.20 cm to about 0.60 cm, about 0.25 cm to about 0.55 cm, about 0.30 cm to about 0.50 cm, or about 0.35 cm to about 0.45 cm.

In a further aspect, each layer has a different density. In a still further aspect, each layer has a density of less than about 1.2 $g/cm^3$, less than about 1.0 $g/cm^3$, less than about 0.8 $g/cm^3$, less than about 0.8 $g/cm^3$, less than about 0.6 $g/cm^3$, less than about 0.4 $g/cm^3$, less than about 0.2 $g/cm^3$, or less than about 0.1 $g/cm^3$. In yet a further aspect, each layer has a density that is the same as or greater than the density of the remainder of the inner sole (i.e., the portion of the inner sole that is not made up of the support portion and/or the first, second, or third cushioning portion).

In a further aspect, the support portion has a density that is the same as or greater than the density of the remainder of the inner sole (i.e., the portion of the inner sole that is not made up of the support portion and/or the first, second, or third cushioning portion). In a still further aspect, the support portion has a density that is the same as or greater than the density of the first, second, and/or third cushioning portion, when present. In yet a further aspect, the support portion has a density that is the same as or greater than the density of the first, second, and third cushioning portion, when present.

In a further aspect, the support portion comprises: (a) a first layer of EVA foam, wherein the first layer has a thickness of about 0.32 cm; (b) a second layer of polyurethane foam, wherein the second layer has a thickness of about 0.16 cm; and (c) a third layer of polyethylene foam, wherein the third layer has a thickness of about 0.64 cm. In a further aspect, the support portion comprises: (a) a first layer of polyethylene foam, wherein the first layer has a thickness of about 0.32 cm; (b) a second layer of polyurethane foam, wherein the second layer has a thickness of about 0.16 cm; and (c) a third layer of EVA foam, wherein the third layer has a thickness of about 0.64 cm.

In a further aspect, the support portion is an integral part of the inner sole.

In a further aspect, the support portion is an insert that is attached to the inner sole. In a still further aspect, attached is reversibly attached. In yet a further aspect, attached is permanently attached.

In a further aspect, the inner sole further comprises a cushioning portion in the forefoot interior quadrant, as further described herein.

In a further aspect, the inner sole further comprises a cushioning portion that extends from the forefoot interior quadrant to the forefoot exterior quadrant, as further described herein.

In a further aspect, the inner sole further comprises a cushioning portion in the rearfoot interior quadrant and the rearfoot exterior quadrant, as further described herein.

2. Cushioning Portions in the Forefoot Interior Quadrant

In one aspect, the shoe insole comprises an inner sole having a first cushioning portion in the forefoot interior quadrant.

In one aspect, the inner sole has a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$.

Thus, in various aspects, the first cushioning portion of the insole has a surface area of from about 10 cm$^2$ to about 30 cm$^2$, about 10 cm$^2$ to about 25 cm$^2$, about 10 cm$^2$ to about 20 cm$^2$, about 10 cm$^2$ to about 15 cm$^2$, about 15 cm$^2$ to about 30 cm$^2$, about 20 cm$^2$ to about 30 cm$^2$, about 25 cm$^2$ to about 30 cm$^2$, or about 15 cm$^2$ to about 25 cm$^2$. In a further aspect, the first cushioning portion of the insole has a surface area of from about 17 cm$^2$ to about 18 cm$^2$.

In various aspects, the first cushioning portion of the insole has a cross-sectional area of from about 0.5 cm$^2$ to about 5 cm$^2$, about 0.5 cm$^2$ to about 4 cm$^2$, about 0.5 cm$^2$ to about 3 cm$^2$, about 0.5 cm$^2$ to about 2 cm$^2$, about 0.5 cm$^2$ to about 1 cm$^2$, about 1 cm$^2$ to about 5 cm$^2$, about 2 cm$^2$ to about 5 cm$^2$, about 3 cm$^2$ to about 5 cm$^2$, about 4 cm$^2$ to about 5 cm$^2$, about 1 cm$^2$ to about 4 cm$^2$, or about 2 cm$^2$ to about 3 cm$^2$. In a further aspect, the first cushioning portion of the insole has a cross-sectional area of from about 2 cm$^2$ to about 3 cm$^2$.

Without wishing to be bound by theory, the disclosed cushioning portion in the forefoot interior quadrant can provide cushioning and support to the metatarsal heads (i.e., the joint just under the big toe). The disclosed cushioning portion can also help to align the foot and ease pain (e.g., by improving comfort).

Figure 5A:
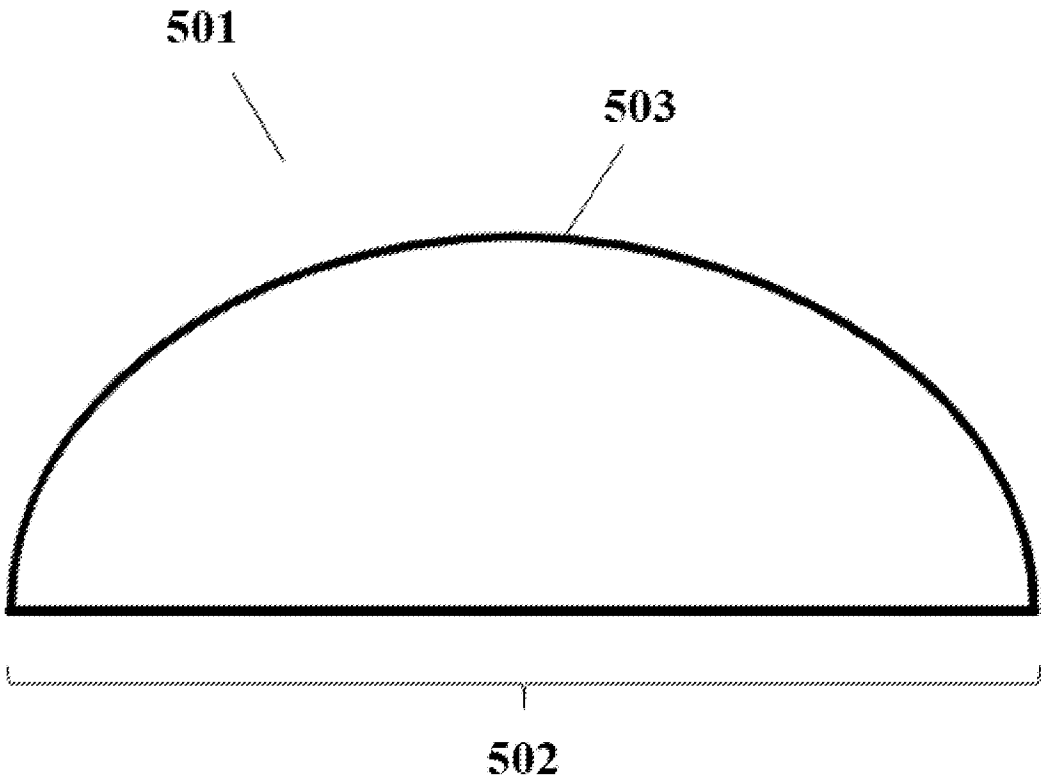
FIG. 5A-C show representative images of a top view (FIG. 5A), a side view (FIG. 5B), and a cross-sectional side view (FIG. 5C) of a cushioning portion, for example, a first cushioning portion.
Figure 5B:
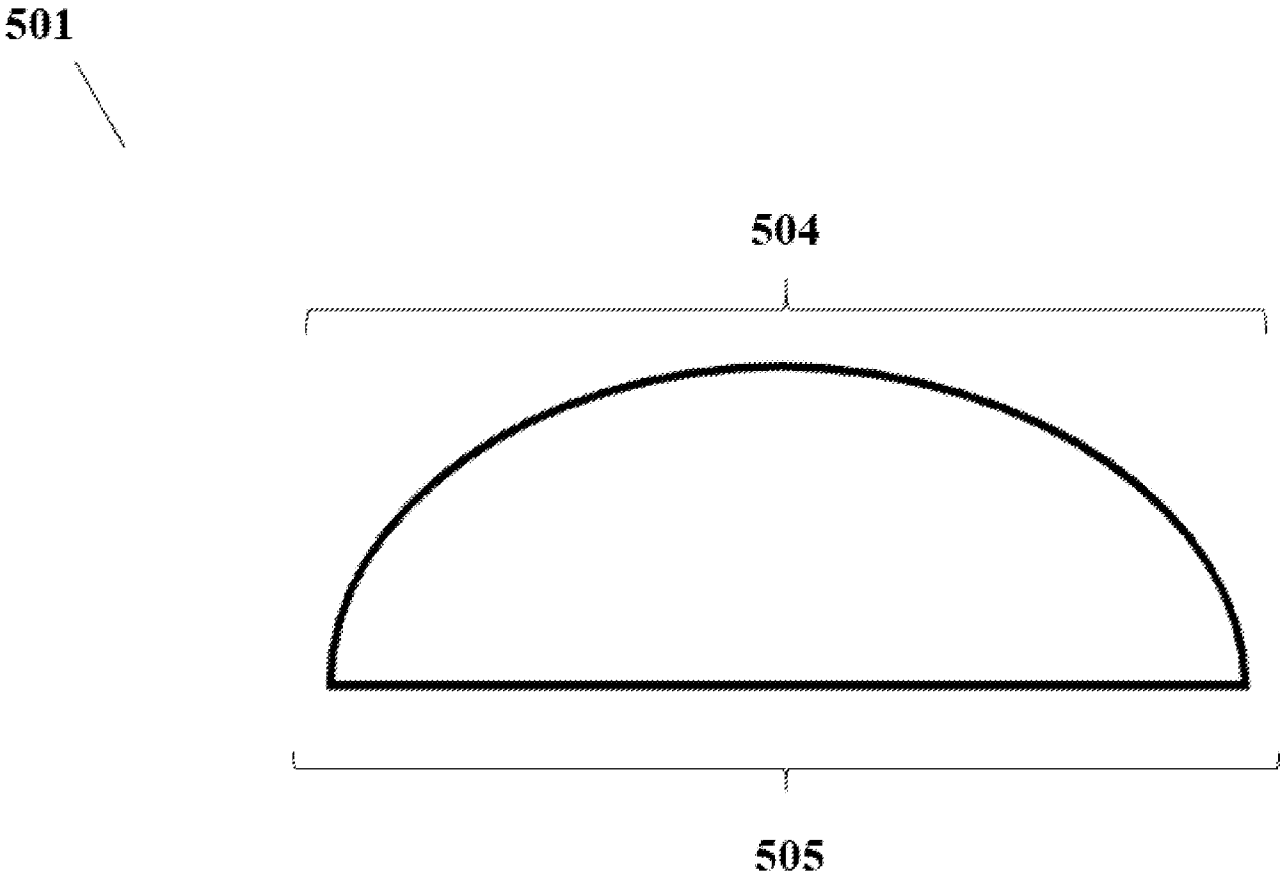
Figure 5C:
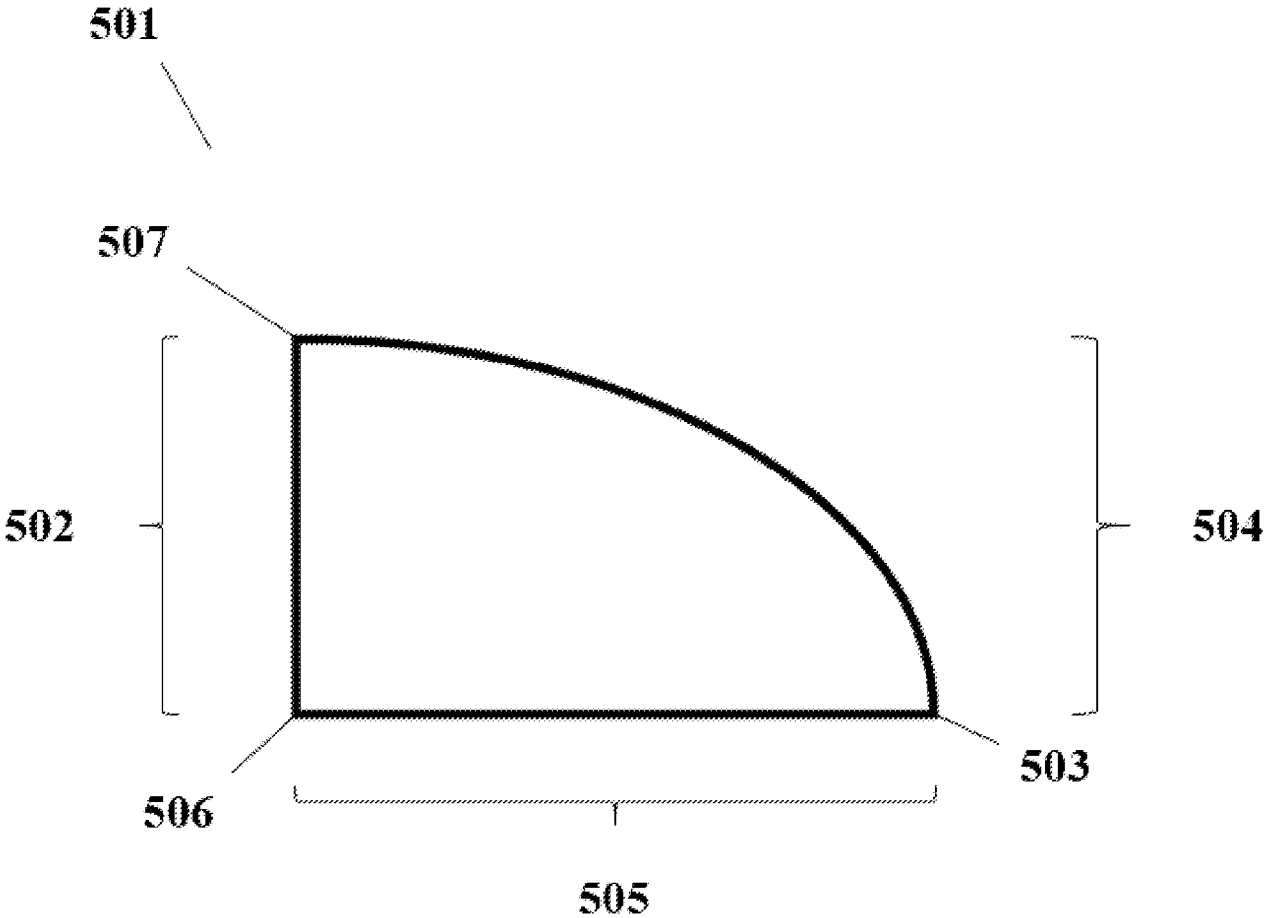

Referring to FIG. 5A-C, first cushioning portion 501 is bounded by second portion of the top surface 504, second portion of the bottom surface 505, and first portion of the inner lateral surface 502. As shown in FIG. 5A, first cushioning portion 501 has a semi-ellipsoid cross-section, although alternative shapes such as, for example, a semi-circle, a semi-oval, a square, or a rectangle, are also envisioned. As shown in FIG. 5C, first cushioning portion 501 has a quarter-ellipsoid cross-section in a z-plane relative to second portion of the bottom surface 505 and first portion of the inner lateral surface 502, although alternative shapes such as, for example, a quarter-circle or a quarter-oval, are also envisioned. Second portion of the bottom surface 505 extends from second portion of the exterior bottom edge 506 to second inner edge 503. As shown, second inner edge 503 is arc-shaped; however, alternative shapes such as, for example, a square-shape or a rectangle-shape, are also envisioned. As shown, second portion of the exterior bottom edge 506 is substantially linear, although alternative shapes are also envisioned. First portion of the inner lateral surface 502 extends from second portion of the exterior bottom edge 506 to second portion of the exterior top edge 507.

In a further aspect, the first cushioning portion has a thickness of from about 0.7 cm to about 1.0 cm, about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm. In a still further aspect, the first cushioning portion has a thickness of about 1.0 cm.

In various aspects, a first region of the first cushioning portion comprises a material that is the same as that used in the remainder of the inner sole. The first region can have a thickness of, for example, from about 0.2 cm to about 0.4 cm, about 0.2 cm to about 0.35 cm, about 0.2 cm to about 0.3 cm, about 0.2 cm to about 0.25 cm, about 0.25 cm to about 0.4 cm, about 0.3 cm to about 0.4 cm, about 0.35 cm to about 0.4 cm, or about 0.25 cm to about 0.35 cm. In a further aspect, the first region has a thickness of about 0.3 cm.

In various aspects, a second region of the first cushioning portion comprises a material that is different than that used in the remainder of the inner sole. The second region can have a thickness of, for example, from about 0.6 cm to about 0.8 cm, about 0.6 cm to about 0.75 cm, about 0.6 cm to about 0.7 cm, about 0.6 cm to about 0.65 cm, about 0.65 cm to about 0.8 cm, about 0.7 cm to about 0.8 cm, about 0.75 cm to about 0.8 cm, or about 0.65 cm to about 0.75 cm. In a still further aspect, the second region has a thickness of about 0.7 cm.

In various aspects, the second region of the first cushioning portion has a surface area of from about 10 cm$^2$ to about 30 cm$^2$, about 10 cm$^2$ to about 25 cm$^2$, about 10 cm$^2$ to about 20 cm$^2$, about 10 cm$^2$ to about 15 cm$^2$, about 15 cm$^2$ to about 30 cm$^2$, about 20 cm$^2$ to about 30 cm$^2$, about 25 cm$^2$ to about 30 cm$^2$, or about 15 cm$^2$ to about 25 cm$^2$. In a further aspect, the second region of the first cushioning portion has a surface area of from about 15 cm$^2$ to about 16 cm$^2$.

In various aspects, the second region of the first cushioning portion has a cross-sectional area of from about 0.5 cm$^2$ to about 5 cm$^2$, about 0.5 cm$^2$ to about 4 cm$^2$, about 0.5 cm$^2$ to about 3 cm$^2$, about 0.5 cm$^2$ to about 2 cm$^2$, about 0.5 cm$^2$ to about 1 cm$^2$, about 1 cm$^2$ to about 5 cm$^2$, about 2 cm$^2$ to about 5 cm$^2$, about 3 cm$^2$ to about 5 cm$^2$, about 4 cm$^2$ to about 5 cm$^2$, about 1 cm$^2$ to about 4 cm$^2$, or about 2 cm$^2$ to about 3 cm$^2$. In a further aspect, the second region of the first cushioning portion has a cross-sectional area of from about 1 cm$^2$ to about 2 cm$^2$.

In a further aspect, the first cushioning portion is bounded by a second portion of the top surface, a second portion of the bottom surface, and a first portion of the inner lateral surface.

In a further aspect, the second portion of the bottom surface extends from a second portion of the exterior bottom edge to a second inner edge. In a still further aspect, the second inner edge is substantially linear. In yet a further aspect, the second inner edge is arc-shaped.

In a further aspect, the second portion of the bottom surface has a semi-circular cross-section. In a still further aspect, the second portion of the bottom surface has a semi-oval cross-section. In yet a further aspect, the second portion of the bottom surface has a semi-ellipsoid cross-section.

In a further aspect, the second portion of the top surface is of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the second portion of the bottom surface. In a still further aspect, the second portion of the top surface is about 1.0 cm from the second portion of the bottom surface.

In a further aspect, the second portion of the top surface extends to a maximum distance of from about 2.0 cm to about 4.0 cm, about 2.0 cm to about 3.8 cm, about 2.0 cm to about 3.6 cm, about 2.0 cm to about 3.4 cm, about 2.0 cm to about 3.2 cm, about 2.0 cm to about 3.0 cm, about 2.0 cm to about 2.8 cm, about 2.0 cm to about 2.6 cm, about 2.0 cm to about 2.4 cm, about 2.0 cm to about 2.2 cm, about 2.2 cm to about 4.0 cm, about 2.4 cm to about 4.0 cm, about 2.6 cm to about 4.0 cm, about 2.8 cm to about 4.0 cm, about 3.0 cm to about 4.0 cm, about 3.2 cm to about 4.0 cm, about 3.4 cm to about 4.0 cm, about 3.6 cm to about 4.0 cm, about 3.8 cm to about 4.0 cm, about 2.2 cm to about 3.8 cm, about 2.4 cm to about 3.6 cm, about 2.6 cm to about 3.4 cm, or about 2.8 cm to about 3.2 cm from the first portion of the inner lateral surface. In a still further aspect, the second portion of the top surface extends to a maximum distance of about 3.0 cm from the first portion of the inner lateral surface.

In a further aspect, the second inner edge extends to a maximum distance of from about 2.0 cm to about 4.0 cm, about 2.0 cm to about 3.8 cm, about 2.0 cm to about 3.6 cm, about 2.0 cm to about 3.4 cm, about 2.0 cm to about 3.2 cm, about 2.0 cm to about 3.0 cm, about 2.0 cm to about 2.8 cm, about 2.0 cm to about 2.6 cm, about 2.0 cm to about 2.4 cm, about 2.0 cm to about 2.2 cm, about 2.2 cm to about 4.0 cm, about 2.4 cm to about 4.0 cm, about 2.6 cm to about 4.0 cm, about 2.8 cm to about 4.0 cm, about 3.0 cm to about 4.0 cm, about 3.2 cm to about 4.0 cm, about 3.4 cm to about 4.0 cm, about 3.6 cm to about 4.0 cm, about 3.8 cm to about 4.0 cm, about 2.2 cm to about 3.8 cm, about 2.4 cm to about 3.6 cm, about 2.6 cm to about 3.4 cm, or about 2.8 cm to about 3.2 cm from the first portion of the inner lateral surface. In a still further aspect, the second inner edge extends to a maximum distance of about 3.0 cm from the first portion of the inner lateral surface.

In a further aspect, the second portion of the bottom surface is substantially perpendicular to the first portion of the inner lateral surface.

In a further aspect, the first portion of the inner lateral surface extends from a second portion of the exterior bottom edge to a second portion of the exterior top edge.

In a further aspect, the second portion of the exterior top edge is of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the second portion of the bottom surface. In a still further aspect, the second portion of the exterior top edge is about 1.0 cm from the second portion of the bottom surface.

In a further aspect, the second portion of the bottom surface extends to a maximum distance of from about 2.0 cm to about 4.0 cm, about 2.0 cm to about 3.8 cm, about 2.0 cm to about 3.6 cm, about 2.0 cm to about 3.4 cm, about 2.0 cm to about 3.2 cm, about 2.0 cm to about 3.0 cm, about 2.0 cm to about 2.8 cm, about 2.0 cm to about 2.6 cm, about 2.0 cm to about 2.4 cm, about 2.0 cm to about 2.2 cm, about 2.2 cm to about 4.0 cm, about 2.4 cm to about 4.0 cm, about 2.6 cm to about 4.0 cm, about 2.8 cm to about 4.0 cm, about 3.0 cm to about 4.0 cm, about 3.2 cm to about 4.0 cm, about 3.4 cm to about 4.0 cm, about 3.6 cm to about 4.0 cm, about 3.8 cm to about 4.0 cm, about 2.2 cm to about 3.8 cm, about 2.4 cm to about 3.6 cm, about 2.6 cm to about 3.4 cm, or about 2.8 cm to about 3.2 cm from the second portion of the exterior bottom edge. In a still further aspect, the second portion of the bottom surface extends to a maximum distance of about 3.0 cm from the second portion of the exterior bottom edge.

In a further aspect, the second portion of the exterior bottom edge has a length of from about 5.0 cm to about 7.0 cm, about 5.0 cm to about 6.8 cm, about 5.0 cm to about 6.6 cm, about 5.0 cm to about 6.4 cm, about 5.0 cm to about 6.2 cm, about 5.0 cm to about 6.0 cm, about 5.0 cm to about 5.8 cm, about 5.0 cm to about 5.6 cm, about 5.0 cm to about 5.4 cm, about 5.2 cm to about 7.0 cm, about 5.4 cm to about 7.0 cm, about 5.6 cm to about 7.0 cm, about 5.8 cm to about 7.0 cm, about 6.0 cm to about 7.0 cm, about 6.2 cm to about 7.0 cm, about 6.4 cm to about 7.0 cm, about 6.6 cm to about 7.0 cm, about 5.2 cm to about 6.8 cm, about 5.4 cm to about 6.6 cm, about 5.6 cm to about 6.4 cm, or about 5.8 cm to about 6.2 cm. In a still further aspect, the second portion of the exterior bottom edge has a length of about 6.0 cm.

In a further aspect, the first portion of the inner lateral surface extends of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the second portion of the exterior bottom edge. In a still further aspect, the first portion of the inner lateral surface extends about 0.7 cm from the second portion of the exterior bottom edge.

In a further aspect, the first cushioning portion comprises a medical grade foam. Examples of medical grade foam include, but are not limited to, ethylene vinyl acetate (EVA) foam, polyurethane foam, and polyethylene foam. In a still further aspect, the first cushioning portion comprises a different material than the support portion. For example, the material can differ in density and/or durometer from the material in the support portion.

In a further aspect, the first cushioning portion has a durometer that is the same as or greater than the support portion. Thus, in various aspects, the first cushioning portion can have a durometer of from about 15 N to about 80 N, about 15 N to about 75 N, about 15 N to about 70 N, about 15 N to about 65 N, about 15 N to about 60 N, about 15 N to about 55 N, about 15 N to about 50 N, about 15 N to about 45 N, about 15 N to about 40 N, about 15 N to about 35 N, about 15 N to about 30 N, about 15 N to about 25 N, about 15 N to about 20 N, about 20 N to about 80 N, about 25 N to about 80 N, about 30 N to about 80 N, about 35 N to about 80 N, about 40 N to about 80 N, about 45 N to about 80 N, about 50 N to about 80 N, about 55 N to about 80 N, about 60 N to about 80 N, about 65 N to about 80 N, about 70 N to about 80 N, about 75 N to about 80 N, about 20 N to about 75 N, about 25 N to about 70 N, about 30 N to about 65 N, about 35 N to about 60 N, about 40 N to about 55 N, or about 45 N to about 50 N.

In a further aspect, the first cushioning portion has a density that is less than the density of the remainder of the inner sole (i.e., the portion of the inner sole that is not made up of the support portion and/or the first, second, or third cushioning portion). In a still further aspect, the first cushioning portion has a density that is less than the density of the support portion.

In a further aspect, the first cushioning portion has a density of less than about 1.2 g/cm$^3$, less than about 1.0 g/cm$^3$, less than about 0.8 g/cm$^3$, less than about 0.8 g/cm$^3$, less than about 0.6 g/cm$^3$, less than about 0.4 g/cm$^3$, less than about 0.2 g/cm$^3$, or less than about 0.1 g/cm$^3$.

In a further aspect, the first cushioning portion has a density of from about 0.03 g/cm$^3$ to about 0.4 g/cm$^3$, about 0.03 g/cm$^3$ to about 0.3 g/cm$^3$, about 0.03 g/cm$^3$ to about 0.2 g/cm$^3$, about 0.03 g/cm$^3$ to about 0.1 g/cm$^3$, about 0.03 g/cm$^3$ to about 0.09 g/cm$^3$, about 0.03 g/cm$^3$ to about 0.08 g/cm$^3$, about 0.03 g/cm$^3$ to about 0.07 g/cm$^3$, about 0.03 g/cm$^3$ to about 0.06 g/cm$^3$, about 0.03 g/cm$^3$ to about 0.05 g/cm$^3$, about 0.03 g/cm$^3$ to about 0.04 g/cm$^3$, about 0.04 g/cm$^3$ to about 0.4 g/cm$^3$, about 0.05 g/cm$^3$ to about 0.4 g/cm$^3$, about 0.06 g/cm$^3$ to about 0.4 g/cm$^3$, about 0.07 g/cm$^3$ to about 0.4 g/cm$^3$, about 0.08 g/cm$^3$ to about 0.4 g/cm$^3$, about 0.09 g/cm$^3$ to about 0.4 g/cm$^3$, about 0.1 g/cm$^3$ to about 0.4 g/cm$^3$, about 0.2 g/cm$^3$ to about 0.4 g/cm$^3$, about 0.3 g/cm$^3$ to about 0.4 g/cm$^3$, about 0.04 g/cm$^3$ to about 0.3 g/cm$^3$, about 0.05 g/cm$^3$ to about 0.2 g/cm$^3$, about 0.06 g/cm$^3$ to about 0.1 g/cm$^3$, or about 0.07 g/cm$^3$ to about 0.09 g/cm$^3$.

In a further aspect, the first cushioning portion is an integral part of the inner sole.

In a further aspect, the first cushioning portion is an insert that is attached to the inner sole. In a still further aspect, attached is reversibly attached. In yet a further aspect, attached is permanently attached.

In a further aspect, the inner sole further comprises a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$, as further described herein.

In a further aspect, the inner sole further comprises a cushioning portion that extends from the forefoot interior quadrant to the forefoot exterior quadrant, as further described herein.

In a further aspect, the inner sole further comprises a cushioning portion in the rearfoot interior quadrant and the rearfoot exterior quadrant, as further described herein.

3. Cushioning Portions that Extend from the Forefoot Interior Quadrant to the Forefoot Exterior Quadrant In one aspect, the shoe insole comprises an inner sole having a second cushioning portion that extends from the forefoot interior quadrant to the forefoot exterior quadrant.

In one aspect, the inner sole has a cushioning portion that extends from the forefoot interior quadrant to the forefoot exterior quadrant, wherein the cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$.

Thus, in various aspects, the second cushioning portion of the insole has a surface area of from about 25 cm$^2$ to about 50 cm$^2$, about 25 cm$^2$ to about 45 cm$^2$, about 25 cm$^2$ to about 40 cm$^2$, about 25 cm$^2$ to about 35 cm$^2$, about 25 cm$^2$ to about 30 cm$^2$, about 30 cm$^2$ to about 50 cm$^2$, about 35 cm$^2$ to about 50 cm$^2$, about 40 cm$^2$ to about 50 cm$^2$, about 45 cm$^2$ to about 50 cm$^2$, about 30 cm$^2$ to about 45 cm$^2$, or about 35 cm$^2$ to about 40 cm$^2$. In a further aspect, the second cushioning portion of the insole has a surface area of from about 33 cm$^2$ to about 34 cm$^2$.

In various aspects, the second cushioning portion of the insole has a cross-sectional area of from about 25 cm$^2$ to about 45 cm$^2$, about 25 cm$^2$ to about 40 cm$^2$, about 25 cm$^2$ to about 35 cm$^2$, about 25 cm$^2$ to about 30 cm$^2$, about 30 cm$^2$ to about 45 cm$^2$, about 35 cm$^2$ to about 45 cm$^2$, about 40 cm$^2$ to about 45 cm$^2$, or about 30 cm$^2$ to about 40 cm$^2$. In a further aspect, the second cushioning portion of the insole has a cross-sectional area of from about 33 cm$^2$ to about 34 cm$^2$.

Without wishing to be bound by theory, a cushioning portion that extends from the forefoot interior quadrant to the forefoot exterior quadrant can be useful for offering comfort and relief to the ball-of the foot and/or forefoot. Such a cushioning portion can, for example, distribute body weight and, thus, decrease the impact of pressure. In various aspects, the cushioning portion can also reduce pain from bunions and other foot problems.

Figure 6A:
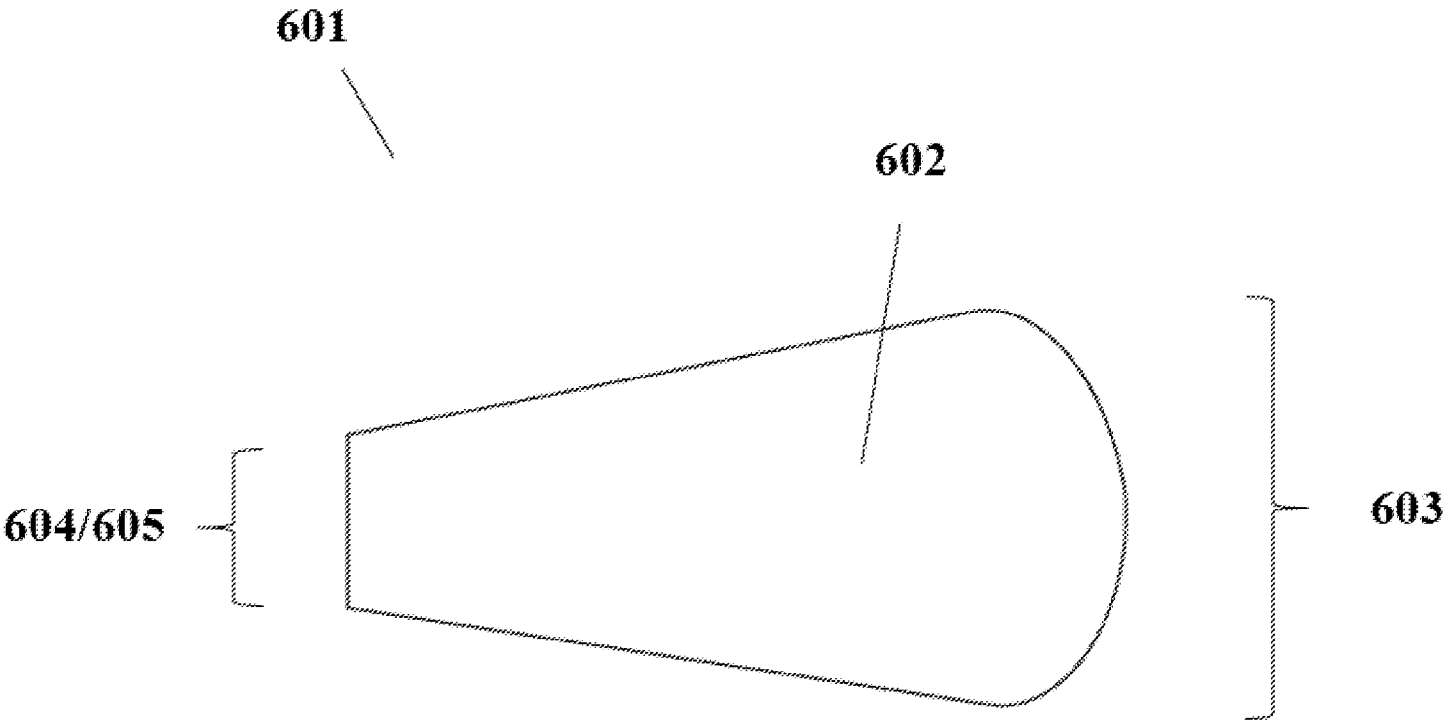
FIG. 6A-C show representative images of a top view (FIG. 6A), a side view (FIG. 6B), and a cross-sectional side view (FIG. 6C) of a cushioning portion, for example, a second cushioning portion.
Figure 6B:
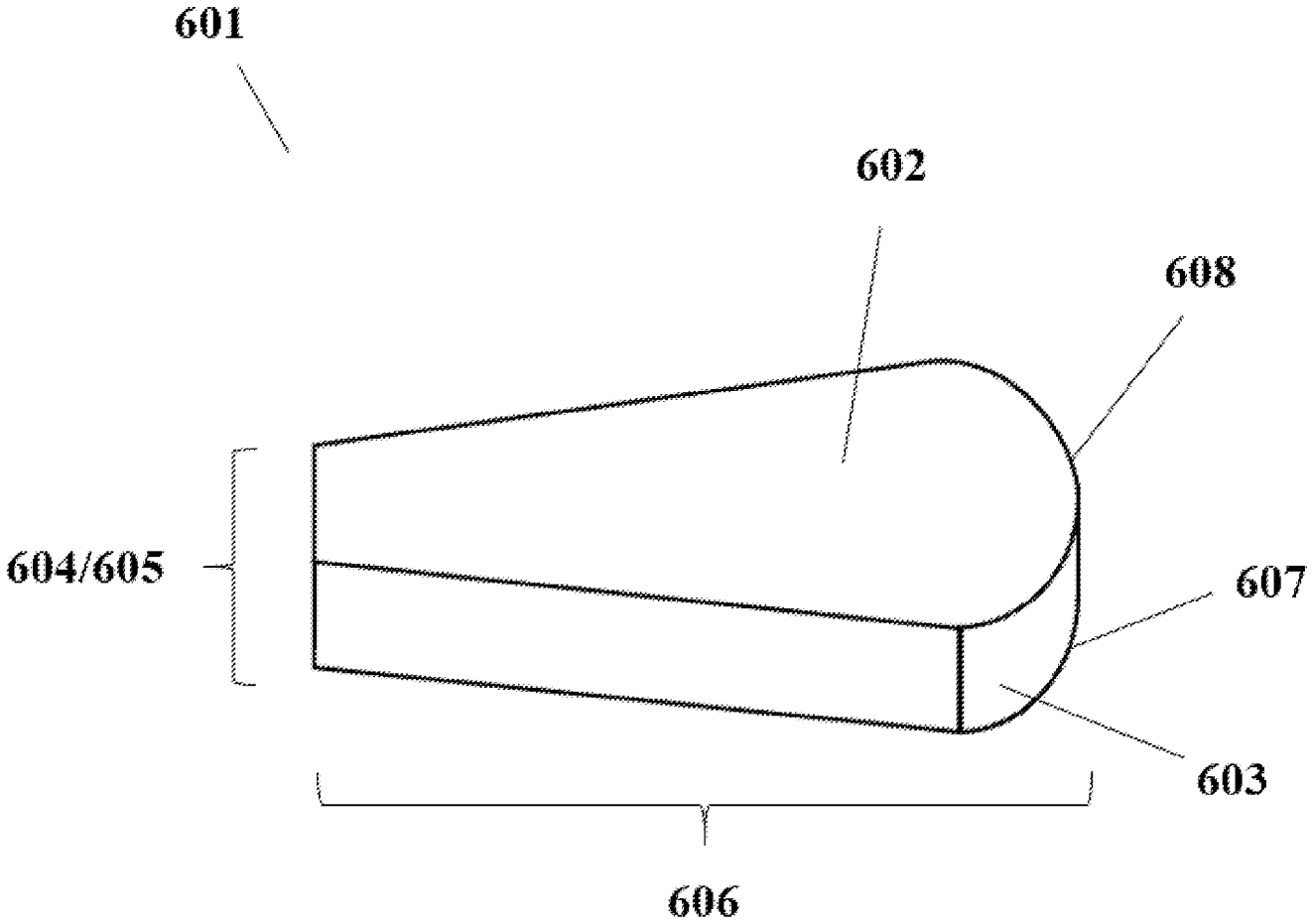
Figure 6C:
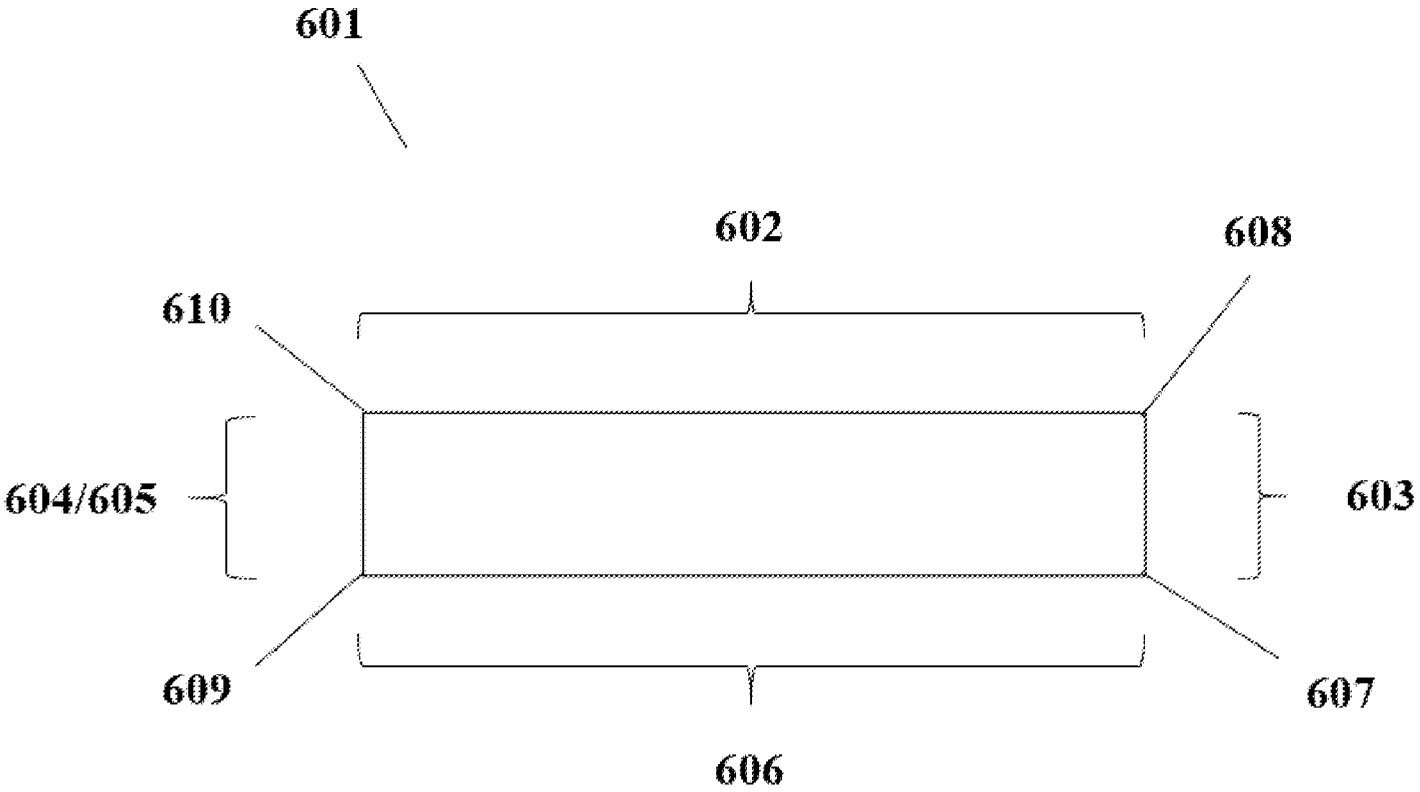

Referring to FIG. 6A-C, second cushioning portion 601 is bounded by third portion of the top surface 602, third portion of the bottom surface 606, second portion of the exterior lateral surface 603, and portion of the first cushioning portion 604. Alternatively, in embodiments in which a first cushioning portion is not present, instead of being bounded by portion of the first cushioning portion 604, second cushioning portion 601 is bounded by third portion of interior lateral surface 605. As shown in FIG. 6C, second cushioning portion 601 has a rectangular cross-section in a z-plane relative to third portion of the bottom surface 606 and second portion of exterior lateral surface 603, although alternative shapes are also envisioned. Third portion of the bottom surface 606 extends from third portion of the exterior bottom edge 607 to third inner edge 609. As shown, third inner edge 609 is substantially linear; however, alternative shapes such as, for example, an arc-shape, are also envisioned. As shown, third portion of the exterior bottom edge 607 is arc-shaped, although alternative shapes such as, for example, linear or substantially linear, are also envisioned. Second portion of the exterior lateral surface 603 extends from third portion of the exterior bottom edge 607 to third portion of the exterior top edge 608.

In a further aspect, the second cushioning portion has a thickness of from about 0.7 cm to about 1.0 cm, about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm. In a still further aspect, the second cushioning portion has a thickness of about 1.0 cm.

In various aspects, a first region of the second cushioning portion comprises a material that is the same as that used in the remainder of the inner sole. The first region can have a thickness of, for example, from about 0.2 cm to about 0.4 cm, about 0.2 cm to about 0.35 cm, about 0.2 cm to about 0.3 cm, about 0.2 cm to about 0.25 cm, about 0.25 cm to about 0.4 cm, about 0.3 cm to about 0.4 cm, about 0.35 cm to about 0.4 cm, or about 0.25 cm to about 0.35 cm. In a further aspect, the first region has a thickness of about 0.3 cm.

In various aspects, a second region of the second cushioning portion comprises a material that is different than that used in the remainder of the inner sole. The second region can have a thickness of, for example, from about 0.6 cm to about 0.8 cm, about 0.6 cm to about 0.75 cm, about 0.6 cm to about 0.7 cm, about 0.6 cm to about 0.65 cm, about 0.65 cm to about 0.8 cm, about 0.7 cm to about 0.8 cm, about 0.75 cm to about 0.8 cm, or about 0.65 cm to about 0.75 cm. In a still further aspect, the second region has a thickness of about 0.7 cm.

In a further aspect, the second region of the second cushioning portion has a surface area of from about 15 cm$^2$ to about 40 cm$^2$, about 15 cm$^2$ to about 35 cm$^2$, about 15 cm$^2$ to about 30 cm$^2$, about 15 cm$^2$ to about 25 cm$^2$, about 15 cm$^2$ to about 20 cm$^2$, about 20 cm$^2$ to about 40 cm$^2$, about 25 cm$^2$ to about 40 cm$^2$, about 30 cm$^2$ to about 40 cm$^2$, about 35 cm$^2$ to about 40 cm$^2$, about 20 cm$^2$ to about 35 cm$^2$, or about 25 cm$^2$ to about 30 cm$^2$. In a further aspect, the second region of the second cushioning portion has a surface area of from about 23 cm$^2$ to about 24 cm$^2$.

In various aspects, the second region of the second cushioning portion has a cross-sectional area of from about 25 cm$^2$ to about 45 cm$^2$, about 25 cm$^2$ to about 40 cm$^2$, about 25 cm$^2$ to about 35 cm$^2$, about 25 cm$^2$ to about 30 cm$^2$, about 30 cm$^2$ to about 45 cm$^2$, about 35 cm$^2$ to about 45 cm$^2$, about 40 cm$^2$ to about 45 cm$^2$, or about 30 cm$^2$ to about 40 cm$^2$. In a further aspect, the second region of the second cushioning portion has a cross-sectional area of from about 33 cm$^2$ to about 34 cm$^2$.

In a further aspect, the second cushioning portion is bounded by a third portion of the top surface, a third portion of the bottom surface, a second portion of the exterior lateral surface, and a portion of the first cushioning portion. In a still further aspect, the third portion of the bottom surface extends from a third portion of the exterior bottom edge to a third inner edge.

In a further aspect, the third portion of the top surface is of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the third portion of the bottom surface. In a still further aspect, the third portion of the top surface is about 1.0 cm from the third portion of the bottom surface.

In a further aspect, the third portion of the top surface extends to a maximum distance of from about 6.0 cm to about 11.0 cm, about 6.0 cm to about 10.5 cm, about 6.0 cm to about 10.0 cm, about 6.0 cm to about 9.5 cm, about 6.0 cm to about 9.0 cm, about 6.0 cm to about 8.5 cm, about 6.0 cm to about 8.0 cm, about 6.0 cm to about 7.5 cm, about 6.0 cm to about 7.0 cm, about 6.5 cm to about 11.0 cm, about 7.0 cm to about 11.0 cm, about 7.5 cm to about 11.0 cm, about 8.0 cm to about 11.0 cm, about 8.5 cm to about 11.0 cm, about 9.0 cm to about 11.0 cm, about 9.5 cm to about 11.0 cm, about 10.0 cm to about 11.0 cm, about 6.5 cm to about 10.5 cm, about 7.0 cm to about 10.0 cm, about 7.5 cm to about 9.5 cm, or about 8.0 cm to about 9.0 cm from the second portion of the exterior lateral surface. In a still further aspect, the third portion of the top surface extends to a maximum distance of from about 6.5 cm to about 7.5 cm from the second portion of the exterior lateral surface.

In a further aspect, the third inner edge is of from about 5.0 cm to about 8.0 cm, about 5.0 cm to about 7.5 cm, about 5.0 cm to about 7.0 cm, about 5.0 cm to about 6.5 cm, about 5.0 cm to about 6.0 cm, about 5.5 cm to about 8.0 cm, about 6.0 cm to about 8.0 cm, about 6.5 cm to about 8.0 cm, about 7.0 cm to about 8.0 cm, about 5.5 cm to about 7.5 cm, or about 6.0 cm to about 7.0 cm from the first portion of the inner lateral surface. In a still further aspect, the third inner edge is of from about 5.0 cm to about 8.0 cm from the first portion of the inner lateral surface.

In a further aspect, the third inner edge has a length of from about 2.5 cm to about 4.5 cm, about 2.5 cm to about 4.0 cm, about 2.5 cm to about 3.5 cm, about 2.5 cm to about 3.0 cm, about 3.0 cm to about 4.5 cm, about 3.5 cm to about 4.5 cm, about 4.0 cm to about 4.5 cm, or about 3.0 cm to about 4.0 cm. In a still further aspect, the third inner edge has a length of about 3.2 cm.

In a further aspect, second portion of the exterior lateral surface extends from a third portion of the exterior bottom edge to a third portion of the exterior top edge.

In a further aspect, the third portion of the exterior top edge is of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the third portion of the bottom surface. In a still further aspect, the third portion of the exterior top edge is about 1.0 cm from the third portion of the bottom surface.

In a further aspect, the third portion of the bottom surface extends to a maximum distance of from about 6.0 cm to about 11.0 cm, about 6.0 cm to about 10.5 cm, about 6.0 cm to about 10.0 cm, about 6.0 cm to about 9.5 cm, about 6.0 cm to about 9.0 cm, about 6.0 cm to about 8.5 cm, about 6.0 cm to about 8.0 cm, about 6.0 cm to about 7.5 cm, about 6.0 cm to about 7.0 cm, about 6.5 cm to about 11.0 cm, about 7.0 cm to about 11.0 cm, about 7.5 cm to about 11.0 cm, about 8.0 cm to about 11.0 cm, about 8.5 cm to about 11.0 cm, about 9.0 cm to about 11.0 cm, about 9.5 cm to about 11.0 cm, about 10.0 cm to about 11.0 cm, about 6.5 cm to about 10.5 cm, about 7.0 cm to about 10.0 cm, about 7.5 cm to about 9.5 cm, or about 8.0 cm to about 9.0 cm from the third portion of the exterior bottom edge. In a still further aspect, the third portion of the bottom surface extends to a maximum distance of from about 6.0 cm to about 11.0 cm from the third portion of the exterior bottom edge.

In a further aspect, the third portion of the exterior bottom edge has a length of from about 5.5 cm to about 7.0 cm, about 5.5 cm to about 6.5 cm, about 5.5 cm to about 6.0 cm, about 6.0 cm to about 7.5 cm, about 6.5 cm to about 7.5 cm, about 7.0 cm to about 7.5 cm, or about 6.0 cm to about 7.0 cm. In a still further aspect, the third portion of the exterior bottom edge has a length of about 6.5 cm.

In a further aspect, the third portion of the exterior top edge has a length of from about 5.5 cm to about 7.0 cm, about 5.5 cm to about 6.5 cm, about 5.5 cm to about 6.0 cm, about 6.0 cm to about 7.5 cm, about 6.5 cm to about 7.5 cm, about 7.0 cm to about 7.5 cm, or about 6.0 cm to about 7.0 cm. In a still further aspect, the third portion of the exterior top edge has a length of about 6.5 cm.

In a further aspect, the second portion of the exterior lateral surface extends to a distance of from about 6.0 cm to about 11.0 cm, about 6.0 cm to about 10.5 cm, about 6.0 cm to about 10.0 cm, about 6.0 cm to about 9.5 cm, about 6.0 cm to about 9.0 cm, about 6.0 cm to about 8.5 cm, about 6.0 cm to about 8.0 cm, about 6.0 cm to about 7.5 cm, about 6.0 cm to about 7.0 cm, about 6.5 cm to about 11.0 cm, about 7.0 cm to about 11.0 cm, about 7.5 cm to about 11.0 cm, about 8.0 cm to about 11.0 cm, about 8.5 cm to about 11.0 cm, about 9.0 cm to about 11.0 cm, about 9.5 cm to about 11.0 cm, about 10.0 cm to about 11.0 cm, about 6.5 cm to about 10.5 cm, about 7.0 cm to about 10.0 cm, about 7.5 cm to about 9.5 cm, or about 8.0 cm to about 9.0 cm from the third portion of the exterior bottom edge. In a still further aspect, the second portion of the exterior lateral surface extends to a distance of from about 6.5 cm to about 7.5 cm from the third portion of the exterior bottom edge.

In a further aspect, the second cushioning portion comprises a medical grade foam. Examples of medical grade foam include, but are not limited to, ethylene vinyl acetate (EVA) foam, polyurethane foam, and polyethylene foam. In a still further aspect, the second cushioning portion comprises a different material than the support portion. For example, the material can differ in density and/or durometer from the material in the support portion.

In a further aspect, the second cushioning portion has a durometer that is the same as or greater than the support portion. Thus, in various aspects, the second cushioning portion has a durometer of from about 15 N to about 80 N, about 15 N to about 75 N, about 15 N to about 70 N, about 15 N to about 65 N, about 15 N to about 60 N, about 15 N to about 55 N, about 15 N to about 50 N, about 15 N to about 45 N, about 15 N to about 40 N, about 15 N to about 35 N, about 15 N to about 30 N, about 15 N to about 25 N, about 15 N to about 20 N, about 20 N to about 80 N, about 25 N to about 80 N, about 30 N to about 80 N, about 35 N to about 80 N, about 40 N to about 80 N, about 45 N to about 80 N, about 50 N to about 80 N, about 55 N to about 80 N, about 60 N to about 80 N, about 65 N to about 80 N, about 70 N to about 80 N, about 75 N to about 80 N, about 20 N to about 75 N, about 25 N to about 70 N, about 30 N to about 65 N, about 35 N to about 60 N, about 40 N to about 55 N, or about 45 N to about 50 N.

In a further aspect, the second cushioning portion has a density that is less than the density of the remainder of the inner sole (i.e., the portion of the inner sole that is not made up of the support portion and/or the first, second, or third cushioning portion). In a still further aspect, the second cushioning portion has a density that is less than the density of the support portion.

In a further aspect, the second cushioning portion has a density of less than about 0.80 g/cm$^3$, less than about 0.70 g/cm$^3$, less than about 0.60 g/cm$^3$, or less than about 0.50 g/cm$^3$.

In a further aspect, the second cushioning portion has a density of from about 0.03 g/cm$^3$ to about 0.4 g/cm$^3$, about 0.03 g/cm$^3$ to about 0.3 g/cm$^3$, about 0.03 g/cm$^3$ to about 0.2 g/cm$^3$, about 0.03 g/cm$^3$ to about 0.1 g/cm$^3$, about 0.03 g/cm$^3$ to about 0.09 g/cm$^3$, about 0.03 g/cm$^3$ to about 0.08 g/cm$^3$, about 0.03 g/cm$^3$ to about 0.07 g/cm$^3$, about 0.03 g/cm$^3$ to about 0.06 g/cm$^3$, about 0.03 g/cm$^3$ to about 0.05 g/cm$^3$, about 0.03 g/cm$^3$ to about 0.04 g/cm$^3$, about 0.04 g/cm$^3$ to about 0.4 g/cm$^3$, about 0.05 g/cm$^3$ to about 0.4 g/cm$^3$, about 0.06 g/cm$^3$ to about 0.4 g/cm$^3$, about 0.07 g/cm$^3$ to about 0.4 g/cm$^3$, about 0.08 g/cm$^3$ to about 0.4 g/cm$^3$, about 0.09 g/cm$^3$ to about 0.4 g/cm$^3$, about 0.1 g/cm$^3$ to about 0.4 g/cm$^3$, about 0.2 g/cm$^3$ to about 0.4 g/cm$^3$, about 0.3 g/cm$^3$ to about 0.4 g/cm$^3$, about 0.04 g/cm$^3$ to about 0.3 g/cm$^3$, about 0.05 g/cm$^3$ to about 0.2 g/cm$^3$, about 0.06 g/cm$^3$ to about 0.1 g/cm$^3$, or about 0.07 g/cm$^3$ to about 0.9 g/cm$^3$.

In a further aspect, the second cushioning portion is an integral part of the inner sole.

In a further aspect, the second cushioning portion is an insert that is attached to the inner sole. In a still further aspect, attached is reversibly attached. In yet a further aspect, attached is permanently attached.

In a further aspect, the inner sole further comprises a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$, as further described herein.

In a further aspect, the inner sole further comprises a cushioning portion in the forefoot interior quadrant, as further described herein.

In a further aspect, the inner sole further comprises a cushioning portion in the rearfoot interior quadrant and the rearfoot exterior quadrant, as further described herein.

4. Cushioning Portions in the Rearfoot Interior Quadrant and the Rearfoot Exterior Quadrant In one aspect, the disclosed shoe insole comprises an inner sole having a cushioning portion in the rearfoot interior quadrant and the rearfoot exterior quadrant.

In one aspect, the inner sole has a cushioning portion in a rearfoot interior portion and the rearfoot exterior portion, wherein the cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$.

Thus, in various aspects, the third cushioning portion of the insole has a surface area of from about 25 cm$^2$ to about 45 cm$^2$, about 30 cm$^2$ to about 45 cm$^2$, about 35 cm$^2$ to about 45 cm$^2$, about 40 cm$^2$ to about 45 cm$^2$, about 25 cm$^2$ to about 40 cm$^2$, about 25 cm$^2$ to about 35 cm$^2$, about 25 cm$^2$ to about 30 cm$^2$, or about 30 cm$^2$ to about 40 cm$^2$. In a further aspect, the third cushioning portion of the insole has a surface area of from about 37 cm$^2$ to about 38 cm$^2$.

In various aspects, the third cushioning portion of the insole has a cross-sectional area of from about 5 cm$^2$ to about 20 cm$^2$, about 5 cm$^2$ to about 15 cm$^2$, about 5 cm$^2$ to about 10 cm$^2$, about 10 cm$^2$ to about 20 cm$^2$, about 15 cm$^2$ to about 20 cm$^2$, or about 10 cm$^2$ to about 15 cm$^2$. In a further aspect, the third cushioning portion of the insole has a cross-sectional area of from about 12 cm$^2$ to about 13 cm$^2$.

Without wishing to be bound by theory, a cushioning portion in the rearfoot interior quadrant and rearfoot exterior quadrant can provide extra cushioning for the heel of a foot. In various aspects, the cushioning portion can also provide shock absorption and reduce pressure on the heel. As would be understood by one of ordinary skill in the art, heel discomfort can be aggravated by the impact of each step. Here, the extra cushioning provided by the cushioning portion helps to absorb shock and relieve heel discomfort.

Figure 7A:
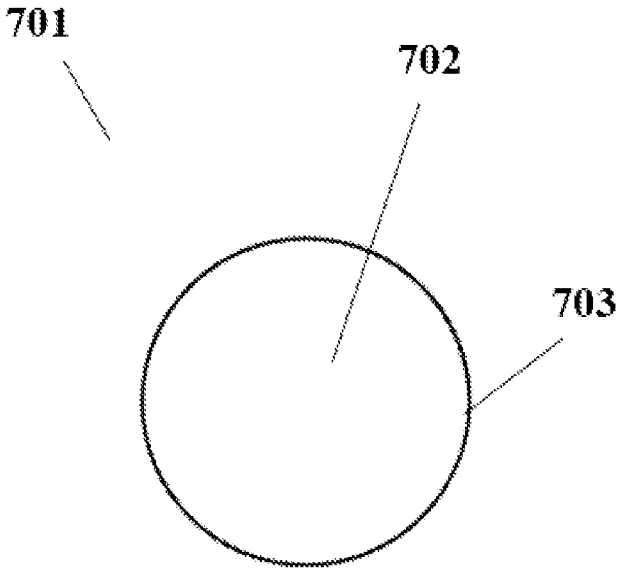
FIG. 7A-C show representative images of a top view (FIG. 7A), a side view (FIG. 7B), and a cross-sectional side view (FIG. 7C) of a cushioning portion, for example, a third cushioning portion.
Figure 7B:
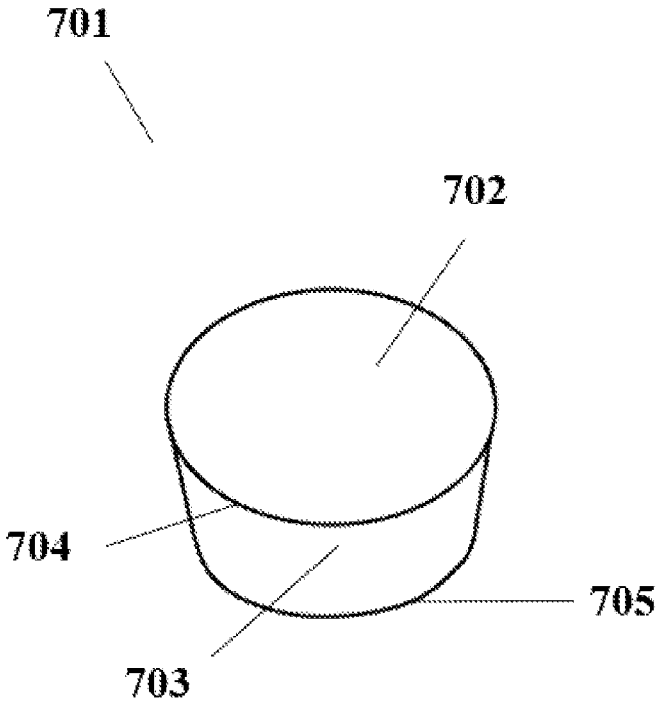
Figure 7C:
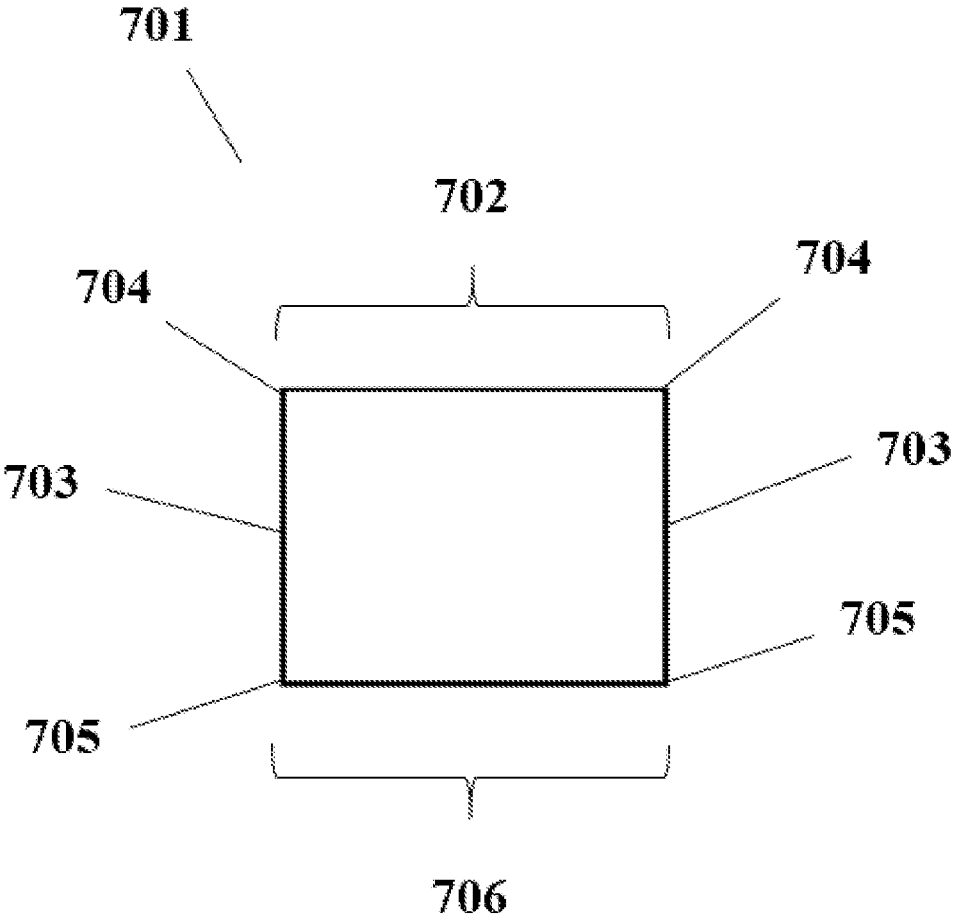

Referring to FIG. 7A-C, third cushioning portion 701 is bounded by fourth portion of the top surface 702, fourth portion of the bottom surface 706, and inner lateral surface 703. As shown in FIG. 7C, third cushioning portion 701 has a square cross-section in a z-plane relative to fourth portion of the bottom surface 706 and inner lateral surface 703, although alternative shapes are also envisioned. As shown, fourth portion of the top surface 702 and fourth portion of the bottom surface 706 each have circular cross-sections; however, alternatively shaped cross-sections are also envisioned. Fourth portion of the top surface 702 is bounded by inner lateral surface 703 at inner top edge 704. Fourth portion of the bottom surface 706 is bounded by inner lateral surface 703 at inner bottom edge 705. As shown, each of inner bottom edge 705 and inner tope edge 704 are circular; however, alternative shapes such as, for example, oval, ellipsoid, square, and rectangular, are also envisioned.

In a further aspect, approximately one-half of the third cushioning portion is in the rearfoot interior quadrant and wherein the other approximately one-half of the third cushioning portion is in the rearfoot exterior quadrant.

In a further aspect, the third cushioning portion has a thickness of from about 0.7 cm to about 1.0 cm, about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm. In a still further aspect, the third cushioning portion has a thickness of about 1.0 cm.

In various aspects, a first region of the third cushioning portion comprises a material that is the same as that used in the remainder of the inner sole. The first region can have a thickness of, for example, from about 0.2 cm to about 0.4 cm, about 0.2 cm to about 0.35 cm, about 0.2 cm to about 0.3 cm, about 0.2 cm to about 0.25 cm, about 0.25 cm to about 0.4 cm, about 0.3 cm to about 0.4 cm, about 0.35 cm to about 0.4 cm, or about 0.25 cm to about 0.35 cm. In a further aspect, the first region has a thickness of about 0.3 cm.

In various aspects, a second region of the third cushioning portion comprises a material that is different than that used in the remainder of the inner sole. The second region can have a thickness of, for example, from about 0.6 cm to about 0.8 cm, about 0.6 cm to about 0.75 cm, about 0.6 cm to about 0.7 cm, about 0.6 cm to about 0.65 cm, about 0.65 cm to about 0.8 cm, about 0.7 cm to about 0.8 cm, about 0.75 cm to about 0.8 cm, or about 0.65 cm to about 0.75 cm. In a still further aspect, the second region has a thickness of about 0.7 cm.

In various aspects, the second region of the third cushioning portion has a surface area of from about 25 cm$^2$ to about 45 cm$^2$, about 30 cm$^2$ to about 45 cm$^2$, about 35 cm$^2$ to about 45 cm$^2$, about 40 cm$^2$ to about 45 cm$^2$, about 25 cm$^2$ to about 40 cm$^2$, about 25 cm$^2$ to about 35 cm$^2$, about 25 cm$^2$ to about 30 cm$^2$, or about 30 cm$^2$ to about 40 cm$^2$. In a further aspect, the third cushioning portion of the insole has a surface area of from about 33 $cm^2$ to about 34 $cm^2$.

In various aspects, the second region of the third cushioning portion has a cross-sectional area of from about 5 $cm^2$ to about 20 $cm^2$, about 5 $cm^2$ to about 15 $cm^2$, about 5 $cm^2$ to about 10 $cm^2$, about 10 $cm^2$ to about 20 $cm^2$, about 15 $cm^2$ to about 20 $cm^2$, or about 10 $cm^2$ to about 15 $cm^2$. In a further aspect, the third cushioning portion of the insole has a cross-sectional area of from about 12 $cm^2$ to about 13 $cm^2$.

In a further aspect, the third cushioning portion is bounded by a fourth portion of the top surface, a fourth portion of a bottom surface, and an inner lateral surface. In a still further aspect, the fourth portion of the top surface is bounded by the inner lateral surface at an inner top edge.

In a further aspect, the fourth portion of the top surface is from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the fourth portion of the bottom surface. In a still further aspect, the fourth portion of the top surface is about 1.0 cm from the fourth portion of the bottom surface.

In a further aspect, the fourth portion of the top surface has a circular cross-section.

In a further aspect, the fourth portion of the top surface has a diameter of from about 3.0 cm to about 5.0 cm, about 3.0 cm to about 4.8 cm, about 3.0 cm to about 4.6 cm, about 3.0 cm to about 4.4 cm, about 3.0 cm to about 4.2 cm, about 3.0 cm to about 4.0 cm, about 3.0 cm to about 3.8 cm, about 3.0 cm to about 3.6 cm, about 3.0 cm to about 3.4 cm, about 3.2 cm to about 5.0 cm, about 3.4 cm to about 5.0 cm, about 3.6 cm to about 5.0 cm, about 3.8 cm to about 5.0 cm, about 4.0 cm to about 5.0 cm, about 4.2 cm to about 5.0 cm, about 4.4 cm to about 5.0 cm, about 4.6 cm to about 5.0 cm, about 3.2 cm to about 4.8 cm, about 3.4 cm to about 4.6 cm, about 3.6 cm to about 4.4 cm, or about 3.8 cm to about 4.2 cm. In a still further aspect, the fourth portion of the top surface has a diameter of about 4.0 cm.

In a further aspect, the inner top edge has a circumference of from about 10 cm to about 15 cm, about 10 cm to about 14.5 cm, about 10 cm to about 14 cm, about 10 cm to about 13.5 cm, about 10 cm to about 13 cm, about 10 cm to about 12.5 cm, about 10 cm to about 12 cm, about 10 cm to about 11.5 cm, about 10 cm to about 11 cm, about 10.5 cm to about 15 cm, about 11 cm to about 15 cm, about 11.5 cm to about 15 cm, about 12 cm to about 15 cm, about 12.5 cm to about 15 cm, about 13 cm to about 15 cm, about 13.5 cm to about 15 cm, about 14 cm to about 15 cm, about 10.5 cm to about 14.5 cm, about 11 cm to about 14 cm, about 11.5 cm to about 13.5 cm, about 12 cm to about 13 cm. In a still further aspect, the inner top edge has a circumference of from about 12 cm to about 13 cm.

In a further aspect, the fourth portion of the bottom surface is bounded by the inner lateral surface at an inner bottom edge.

In a further aspect, the fourth portion of the bottom surface is of from about 0.8 cm to about 1.2 cm, about 0.8 cm to about 1.1 cm, about 0.8 cm to about 1.0 cm, about 0.8 cm to about 0.9 cm, about 0.9 cm to about 1.2 cm, about 1.0 cm to about 1.2 cm, about 1.1 cm to about 1.2 cm, or about 0.9 cm to about 1.1 cm from the fourth portion of the top surface. In a still further aspect, the fourth portion of the bottom surface is about 1.0 cm from the fourth portion of the top surface.

In a further aspect, the fourth portion of the bottom surface has a circular cross-section.

In a further aspect, the fourth portion of the bottom surface has a diameter of from about 3.0 cm to about 5.0 cm, about 3.0 cm to about 4.8 cm, about 3.0 cm to about 4.6 cm, about 3.0 cm to about 4.4 cm, about 3.0 cm to about 4.2 cm, about 3.0 cm to about 4.0 cm, about 3.0 cm to about 3.8 cm, about 3.0 cm to about 3.6 cm, about 3.0 cm to about 3.4 cm, about 3.2 cm to about 5.0 cm, about 3.4 cm to about 5.0 cm, about 3.6 cm to about 5.0 cm, about 3.8 cm to about 5.0 cm, about 4.0 cm to about 5.0 cm, about 4.2 cm to about 5.0 cm, about 4.4 cm to about 5.0 cm, about 4.6 cm to about 5.0 cm, about 3.2 cm to about 4.8 cm, about 3.4 cm to about 4.6 cm, about 3.6 cm to about 4.4 cm, or about 3.8 cm to about 4.2 cm. In a still further aspect, the fourth portion of the bottom surface has a diameter of about 4.0 cm.

In a further aspect, the inner bottom edge has a circumference of from about 10 cm to about 15 cm, about 10 cm to about 14.5 cm, about 10 cm to about 14 cm, about 10 cm to about 13.5 cm, about 10 cm to about 13 cm, about 10 cm to about 12.5 cm, about 10 cm to about 12 cm, about 10 cm to about 11.5 cm, about 10 cm to about 11 cm, about 10.5 cm to about 15 cm, about 11 cm to about 15 cm, about 11.5 cm to about 15 cm, about 12 cm to about 15 cm, about 12.5 cm to about 15 cm, about 13 cm to about 15 cm, about 13.5 cm to about 15 cm, about 14 cm to about 15 cm, about 10.5 cm to about 14.5 cm, about 11 cm to about 14 cm, about 11.5 cm to about 13.5 cm, about 12 cm to about 13 cm. In a still further aspect, the inner bottom edge has a circumference of from about 12 cm to about 13 cm.

In a further aspect, the third cushioning portion comprises a medical grade foam. Examples of medical grade foam include, but are not limited to, ethylene vinyl acetate (EVA) foam, polyurethane foam, and polyethylene foam. In a still further aspect, the third cushioning portion comprises a different material than the support portion. For example, the material can differ in density and/or durometer from the material in the support portion.

In a further aspect, the third cushioning portion has a durometer that is the same as or greater than the support portion. The durometer can be measured using, for example, the ASTM D2240 standard. Thus, in various aspects, the third cushioning portion has a durometer of from about 15 N to about 80 N, about 15 N to about 75 N, about 15 N to about 70 N, about 15 N to about 65 N, about 15 N to about 60 N, about 15 N to about 55 N, about 15 N to about 50 N, about 15 N to about 45 N, about 15 N to about 40 N, about 15 N to about 35 N, about 15 N to about 30 N, about 15 N to about 25 N, about 15 N to about 20 N, about 20 N to about 80 N, about 25 N to about 80 N, about 30 N to about 80 N, about 35 N to about 80 N, about 40 N to about 80 N, about 45 N to about 80 N, about 50 N to about 80 N, about 55 N to about 80 N, about 60 N to about 80 N, about 65 N to about 80 N, about 70 N to about 80 N, about 75 N to about 80 N, about 20 N to about 75 N, about 25 N to about 70 N, about 30 N to about 65 N, about 35 N to about 60 N, about 40 N to about 55 N, or about 45 N to about 50 N.

In a further aspect, the third cushioning portion has a density that is less than the density of the remainder of the inner sole (i.e., the portion of the inner sole that is not made up of the support portion and/or the first, second, or third cushioning portion). In a still further aspect, the third cushioning portion has a density that is less than the density of the support portion.

In a further aspect, the third cushioning portion has a density of less than about 1.2 $g/cm^3$, less than about 1.0 $g/cm^3$, less than about 0.8 $g/cm^3$, less than about 0.8 $g/cm^3$, less than about 0.6 $g/cm^3$, less than about 0.4 $g/cm^3$, less than about 0.2 $g/cm^3$, or less than about 0.1 $g/cm^3$.

In a further aspect, the third cushioning portion has a density of from about 0.03 g/cm$^3$ to about 0.4 g/cm$^3$, about 0.03 g/cm$^3$ to about 0.3 g/cm$^3$, about 0.03 g/cm$^3$ to about 0.2 g/cm$^3$, about 0.03 g/cm$^3$ to about 0.1 g/cm$^3$, about 0.03 g/cm$^3$ to about 0.09 g/cm$^3$, about 0.03 g/cm$^3$ to about 0.08 g/cm$^3$, about 0.03 g/cm$^3$ to about 0.07 g/cm$^3$, about 0.03 g/cm$^3$ to about 0.06 g/cm$^3$, about 0.03 g/cm$^3$ to about 0.05 g/cm$^3$, about 0.03 g/cm$^3$ to about 0.04 g/cm$^3$, about 0.04 g/cm$^3$ to about 0.4 g/cm$^3$, about 0.05 g/cm$^3$ to about 0.4 g/cm$^3$, about 0.06 g/cm$^3$ to about 0.4 g/cm$^3$, about 0.07 g/cm$^3$ to about 0.4 g/cm$^3$, about 0.08 g/cm$^3$ to about 0.4 g/cm$^3$, about 0.09 g/cm$^3$ to about 0.4 g/cm$^3$, about 0.1 g/cm$^3$ to about 0.4 g/cm$^3$, about 0.2 g/cm$^3$ to about 0.4 g/cm$^3$, about 0.3 g/cm$^3$ to about 0.4 g/cm$^3$, about 0.04 g/cm$^3$ to about 0.3 g/cm$^3$, about 0.05 g/cm$^3$ to about 0.2 g/cm$^3$, about 0.06 g/cm$^3$ to about 0.1 g/cm$^3$, or about 0.07 g/cm$^3$ to about 0.9 g/cm$^3$.

In a further aspect, the third cushioning portion is an integral part of the inner sole.

In a further aspect, the third cushioning portion is an insert that is attached to the inner sole. In a still further aspect, attached is reversibly attached. In yet a further aspect, attached is permanently attached.

In a further aspect, the inner sole further comprises a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$, as further described herein.

In a further aspect, the inner sole further comprises a cushioning portion in the forefoot interior quadrant, as further described herein.

In a further aspect, the inner sole further comprises a cushioning portion that extends from the forefoot interior quadrant to the forefoot exterior quadrant, as further described herein.

C. Shoes

Figure 8:
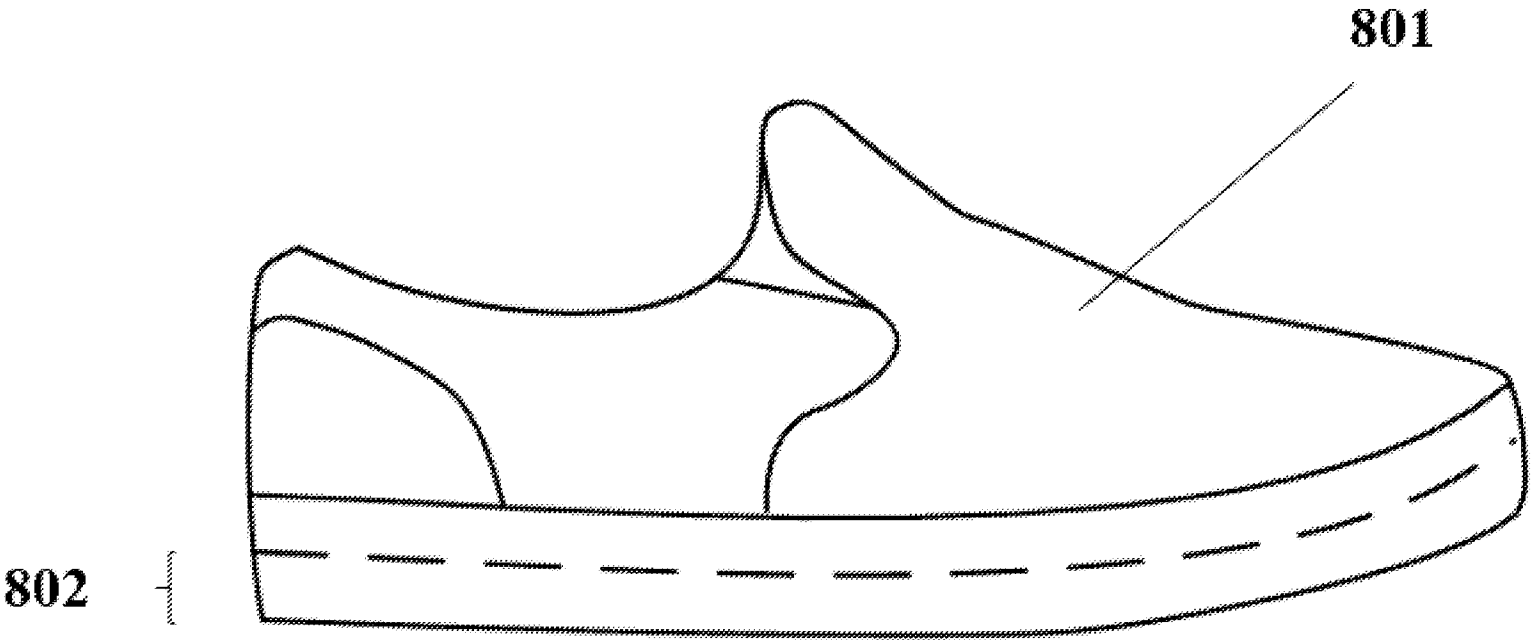
FIG. 8 shows a representative image of a shoe having a shoe insole fabricated therein.

In one aspect, disclosed are shoes having a disclosed insole fabricated as an integral part of the shoe. See, e.g., FIG. 8. In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has one or more of: (a) a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$; (b) a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$; (c) a second cushioning portion that extends from the forefoot interior quadrant to the forefoot exterior quadrant, wherein the second cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$; and (d) a third cushioning portion in a rearfoot interior portion and the rearfoot exterior portion, wherein the cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot.

In a further aspect, the shoe insole has the support portion.

D. Methods of Making a Shoe Insole

In one aspect, disclosed are methods of making a disclosed shoe insole. In a further aspect, the method comprises fabricating a support portion into an inner sole comprising a forefoot interior quadrant, a forefoot exterior quadrant, a rearfoot interior quadrant, and a rearfoot exterior quadrant, thereby making the shoe insole. In a still further aspect, the support portion is fabricated into the rearfoot exterior quadrant.

In a further aspect, the method further comprises fabricating a first cushioning portion into the inner sole, as further described herein. In a still further aspect, the first cushioning portion is fabricated into the forefoot interior quadrant.

In a further aspect, the method further comprises fabricating a second cushioning portion into the inner sole, as further described herein. In yet a further aspect, the second cushioning portion is fabrication into the forefoot interior quadrant and the forefoot exterior quadrant.

In a further aspect, the method further comprises fabricating a third cushioning portion into the inner sole, as further described herein. In yet a further aspect, the third cushioning portion is fabricated into the rearfoot interior quadrant and the rearfoot exterior quadrant.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has one or more of: (a) a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$; (b) a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$; (c) a second cushioning portion that extends from the forefoot interior quadrant to the forefoot exterior quadrant, wherein the cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$; and (d) a third cushioning portion in a rearfoot interior portion and the rearfoot exterior portion, wherein the third cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$, wherein the shoe insole is sized to fit inside a shoe while still allowing room for a wearer's foot. In a further aspect, the inner sole further has a second cushioning portion that extends from the forefoot interior quadrant to the forefoot exterior quadrant.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has a cushioning portion that extends from the forefoot interior quadrant to the forefoot exterior quadrant, wherein the cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$, wherein the shoe insole is sized to fit inside a shoe while still allowing room for a wearer's foot.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and having a cushioning portion in a rearfoot interior portion and the rearfoot exterior portion, wherein the cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a density of greater than about 0.8 g/cm$^3$, and wherein the inner sole has: a support portion in a rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$; a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$; and a second cushioning portion in a rearfoot interior portion and the rearfoot exterior portion, wherein the second cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot. In a further aspect, the inner sole further has a third cushioning portion that extends from the forefoot interior quadrant to the forefoot exterior quadrant. In a further aspect, the shoe insole has the support portion.

E. Methods of Positioning a Shoe Insole

In one aspect, disclosed are methods of positioning a disclosed shoe insole in a shoe, the method comprising placing the shoe insole in the shoe. In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has one or more of: (a) a support portion in the rearfoot exterior quadrant having a thickness of greater than about 1.0 cm and one or more of a surface area of from about 12.5 cm$^2$ to about 80 cm$^2$ and a cross-sectional area of from about 2 cm$^2$ to about 12 cm$^2$; (b) a first cushioning portion in a forefoot interior quadrant, wherein the first cushioning portion has a density of less than about 0.4 g/cm$^3$ and one or more of a surface area of from about 10 cm$^2$ to about 30 cm$^2$ and a cross-sectional area of from about 0.5 cm$^2$ to about 5 cm$^2$; (c) a second cushioning portion that extends from the forefoot interior quadrant to the forefoot exterior quadrant, wherein the second cushioning portion has a density of less than about 0.4 g/cm$^3$ and one or more of a surface area of from about 25 cm$^2$ to about 50 cm$^2$ and a cross-sectional area of from about 25 cm$^2$ to about 45 cm$^2$; and (d) a third cushioning portion in a rearfoot interior portion and the rearfoot exterior portion, wherein the third cushioning portion has a density of less than about 0.4 g/cm$^3$ and one or more of a surface area of from about 25 cm$^2$ to about 45 cm$^2$ and a cross-sectional area of from about 5 cm$^2$ to about 20 cm$^2$, wherein the shoe insole is sized to fit inside a shoe while still allowing room for a wearer's foot. In a further aspect, the shoe insole has the support portion.

F. Methods of Positioning a Support Portion

In one aspect, disclosed are methods of positioning a support portion having a bottom edge and an inner edge in a shoe having an exterior edge and an interior edge, the method comprising placing the support portion in a rearfoot exterior quadrant of the shoe such that the bottom edge is adjacent to the exterior edge and the inner edge extends towards the interior edge.

In a further aspect, the support portion is bounded by a support top surface, a support bottom surface, and a support back surface.

In a further aspect, the support portion has a quarter-ellipsoid cross-section in a z-plane relative to the support bottom surface and the support back surface. In a still further aspect, the support portion has a quarter-circular cross-section in a z-plane relative to the support bottom surface and the support back surface. In yet a further aspect, the support portion has a quarter-oval cross-section in a z-plane relative to the support bottom surface and the support back surface.

In a further aspect, the support top surface is bounded by the support back surface at a top edge and by the support bottom surface at the inner edge.

In a further aspect, each of the top edge and the inner edge are arc-shaped. In a still further aspect, the top edge is arc-shaped. In yet a further aspect, the inner edge is arc-shaped.

In a further aspect, the support bottom surface is bounded by the support top surface at the inner edge and by the support back surface at the bottom edge.

In a further aspect, the support bottom surface has a semi-ellipsoid cross-section. In a still further aspect, the support bottom surface has a semi-circular cross-section. In yet a further aspect, the support bottom surface has a semi-oval cross-section.

In a further aspect, the support bottom surface is substantially perpendicular to the support back surface.

In a further aspect, the support back surface is bounded by the support top surface at a top edge and by the support bottom surface at the bottom edge.

In a further aspect, the support back surface has a semi-ellipsoid cross-section. In a still further aspect, the support back surface has a semi-circular cross-section. In yet a further aspect, the support back surface has a semi-oval cross-section.

In a further aspect, the bottom edge is substantially linear.

In a further aspect, the support portion comprises a plurality of layers. In a still further aspect, the support portion is bounded by a support top surface, a support bottom surface, and a support back surface. In yet a further aspect, the support top surface is formed by a top portion of more than one layer. In an even further aspect, the support bottom surface is formed by only one layer. In a still further aspect, the support back surface is formed by a back surface of more than one layer.

In a further aspect, the support portion comprises two layers.

In a further aspect, the support portion comprises three layers. In a further aspect, the support portion is bounded by a support top surface, a support bottom surface, and a support back surface. In a still further aspect, the support top surface is formed by a top portion of all three layers. In yet a further aspect, the support bottom surface is formed by only one layer. In an even further aspect, the support back surface is formed by a back surface of all three layers.

In a further aspect, at least one of the layers comprise a medical grade foam. Examples of medical grade foam include, but are not limited to, ethylene vinyl acetate (EVA) foam, polyurethane foam, and polyethylene foam. In a still further aspect, each of the layers comprise a medical grade foam. In yet a further aspect, each of the layers comprise a different medical grade foam.

In a further aspect, each layer has a different hardness (durometer) and/or a different thickness.

In a further aspect, each layer has a different durometer. In a still further aspect, each layer has a durometer of from about 15 N to about 80 N, about 15 N to about 75 N, about 15 N to about 70 N, about 15 N to about 65 N, about 15 N to about 60 N, about 15 N to about 55 N, about 15 N to about 50 N, about 15 N to about 45 N, about 15 N to about 40 N, about 15 N to about 35 N, about 15 N to about 30 N, about 15 N to about 25 N, about 15 N to about 20 N, about 20 N to about 80 N, about 25 N to about 80 N, about 30 N to about 80 N, about 35 N to about 80 N, about 40 N to about 80 N, about 45 N to about 80 N, about 50 N to about 80 N, about 55 N to about 80 N, about 60 N to about 80 N, about 65 N to about 80 N, about 70 N to about 80 N, about 75 N to about 80 N, about 20 N to about 75 N, about 25 N to about 70 N, about 30 N to about 65 N, about 35 N to about 60 N, about 40 N to about 55 N, or about 45 N to about 50 N.

In a further aspect, each layer has a different thickness. In a still further aspect, each layer has a thickness of from about 0.16 cm to about 0.64 cm, about 0.16 cm to about 0.60 cm, about 0.16 cm to about 0.55 cm, about 0.16 cm to about 0.50 cm, about 0.16 cm to about 0.45 cm, about 0.16 cm to about 0.40 cm, about 0.16 cm to about 0.35 cm, about 0.16 cm to about 0.30 cm, about 0.16 cm to about 0.25 cm, about 0.16 cm to about 0.20 cm, about 0.20 cm to about 0.64 cm, about 0.25 cm to about 0.64 cm, about 0.30 cm to about 0.64 cm, about 0.35 cm to about 0.64 cm, about 0.40 cm to about 0.64 cm, about 0.45 cm to about 0.64 cm, about 0.50 cm to about 0.64 cm, about 0.60 cm to about 0.64 cm, about 0.20 cm to about 0.60 cm, about 0.25 cm to about 0.55 cm, about 0.30 cm to about 0.50 cm, or about 0.35 cm to about 0.45 cm.

In a further aspect, each layer has a different density. In a still further aspect, each layer has a density of less than about 1.2 $g/cm^3$, less than about 1.0 $g/cm^3$, less than about 0.8 $g/cm^3$, less than about 0.8 $g/cm^3$, less than about 0.6 $g/cm^3$, less than about 0.4 $g/cm^3$, less than about 0.2 $g/cm^3$, or less than about 0.1 $g/cm^3$.

In a further aspect, the support portion comprises: (a) a first layer of EVA foam, wherein the first layer has a thickness of about 0.32 cm; (b) a second layer of polyurethane foam, wherein the second layer has a thickness of about 0.16 cm; and (c) a third layer of polyethylene foam, wherein the third layer has a thickness of about 0.64 cm. In a further aspect, the support portion comprises: (a) a first layer of polyethylene foam, wherein the first layer has a thickness of about 0.32 cm; (b) a second layer of polyurethane foam, wherein the second layer has a thickness of about 0.16 cm; and (c) a third layer of EVA foam, wherein the third layer has a thickness of about 0.64 cm.

In a further aspect, the support portion is fabricated as an integral part of a shoe insole. In a still further aspect, the shoe insole is a disclosed shoe insole.

G. Kits

In one aspect, disclosed are kits comprising a disclosed shoe insole, and one or more of: (a) a shoe; and (b) instructions for positioning a shoe insole in a shoe.

In various aspects, the shoe insole comprises an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, and wherein the inner sole has one or more of: (a) a support portion in the rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$; (b) a first cushioning portion in a forefoot interior quadrant, wherein the first cushioning portion has a density of less than about 0.4 $g/cm^3$ and one or more of a surface area of from about 10 $cm^2$ to about 30 $cm^2$ and a cross-sectional area of from about 0.5 $cm^2$ to about 5 $cm^2$; (c) a second cushioning portion that extends from the forefoot interior quadrant to the forefoot exterior quadrant, wherein the second cushioning portion has a density of less than about 0.4 $g/cm^3$ and one or more of a surface area of from about 25 $cm^2$ to about 50 $cm^2$ and a cross-sectional area of from about 25 $cm^2$ to about 45 $cm^2$; and (d) a third cushioning portion in a rearfoot interior portion and the rearfoot exterior portion, wherein the third cushioning portion has a density of less than about 0.4 $g/cm^3$ and one or more of a surface area of from about 25 $cm^2$ to about 45 $cm^2$ and a cross-sectional area of from about 5 $cm^2$ to about 20 $cm^2$, wherein the shoe insole is sized to fit inside a shoe while still allowing room for a wearer's foot.

In a further aspect, the shoe insole has the support portion.

In a further aspect, the shoe insole is fabricated as an integral part of the shoe. In a still further aspect, the shoe insole and the shoe are separate components.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A shoe insole comprising an inner sole comprising a forefoot interior quadrant, a forefoot exterior quadrant, a rearfoot interior quadrant, and a rearfoot exterior quadrant,
- wherein the inner sole is bounded by a top surface, a bottom surface, a back surface, a front surface, an inner lateral surface, and an outer lateral surface,
  - wherein the top surface is bounded by the back surface, the front surface, the inner lateral surface, and the outer lateral surface at an exterior top edge,
  - wherein the bottom surface is bounded by the back surface, the front surface, the inner lateral surface, and the outer lateral surface at an exterior bottom edge, and
- wherein the inner sole has a support portion in the rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$,
- wherein the support portion comprises:
  - (a) a first layer having a thickness of from about 0.16 cm to about 0.40 cm;
  - (b) a second layer having a thickness of from about 0.16 cm to about 0.20 cm; and
  - (c) a third layer having a thickness of from about 0.60 cm to about 0.64 cm.

2. The shoe insole of claim 1, wherein the inner sole has a density of less than about 1.2 $g/cm^3$.

3. The shoe insole of claim 1, wherein the inner sole comprises a semi-rigid material.

4. The shoe insole of claim 1, wherein the support portion is a curved protrusion.

5. The shoe insole of claim 4, wherein the curved protrusion is shaped as a quarter sphere.

6. The shoe insole of claim 1, wherein at least 50% of the support portion is in an upper half of the rearfoot exterior quadrant.

7. The shoe insole of claim 1, wherein the support portion is bounded by a first portion of the top surface, a first portion of the bottom surface, and a first portion of the outer lateral surface.

8. The shoe insole of claim 7, wherein the support portion has a quarter-ellipsoid cross-section in a z-plane relative to the first portion of the bottom surface and the first portion of the outer lateral surface.

9. The shoe insole of claim 1, wherein the support portion comprises:
- (a) a first layer having a thickness of about 0.32 cm;
- (b) a second layer having a thickness of about 0.16 cm; and
- (c) a third layer having a thickness of about 0.64 cm.

10. The shoe insole of claim 1, wherein the support portion has a density that is the same as or greater than the density of the remainder of the inner sole.

11. The shoe insole of claim 1, wherein the support portion is an integral part of the inner sole.

12. The shoe insole of claim 1, wherein the support portion is an insert that is attached to the inner sole.

13. The shoe insole of claim 1, wherein the inner sole further comprises a first cushioning portion in the forefoot interior quadrant.

14. A shoe having the shoe insole of claim 1 fabricated as an integral part of the shoe.

15. A shoe insole comprising an inner sole comprising a forefoot interior quadrant, a forefoot exterior quadrant, a rearfoot interior quadrant, and a rearfoot exterior quadrant,
- wherein the inner sole is bounded by a top surface, a bottom surface, a back surface, a front surface, an inner lateral surface, and an outer lateral surface,
  - wherein the top surface is bounded by the back surface, the front surface, the inner lateral surface, and the outer lateral surface at an exterior top edge,
  - wherein the bottom surface is bounded by the back surface, the front surface, the inner lateral surface, and the outer lateral surface at an exterior bottom edge,
- wherein the inner sole has a density of greater than about 0.8 $g/cm^3$, and
- wherein the inner sole has a support portion in the rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$,
- wherein the support portion comprises three layers, wherein each layer comprises a different medical grade foam.

16. A shoe having the shoe insole of claim 15 fabricated as an integral part of the shoe.

17. A shoe insole comprising an inner sole comprising a forefoot interior quadrant, a forefoot exterior quadrant, a rearfoot interior quadrant, and a rearfoot exterior quadrant, wherein the inner sole is bounded by a top surface, a bottom surface, a back surface, a front surface, an inner lateral surface, and an outer lateral surface, wherein the top surface is bounded by the back surface, the front surface, the inner lateral surface, and the outer lateral surface at an exterior top edge, wherein the bottom surface is bounded by the back surface, the front surface, the inner lateral surface, and the outer lateral surface at an exterior bottom edge, wherein the inner sole has a support portion in a rearfoot exterior quadrant having a thickness of greater than about 1.0 cm and one or more of a surface area of from about 12.5 $cm^2$ to about 80 $cm^2$ and a cross-sectional area of from about 2 $cm^2$ to about 12 $cm^2$, wherein the support portion comprises three layers and wherein each layer is only in the rearfoot exterior quadrant.

18. A shoe having the shoe insole of claim 17 fabricated as an integral part of the shoe.

19. The shoe insole of claim 15, wherein the support portion comprises:

(a) a first layer of EVA foam;

(b) a second layer of polyurethane foam; and (c) a third layer of polyethylene foam.

20. The shoe insole of claim 17, wherein each layer has a different thickness and wherein each layer comprises a different medical grade foam.

* * * * *